US011713930B2

(12) United States Patent
Shen et al.

(10) Patent No.: US 11,713,930 B2
(45) Date of Patent: Aug. 1, 2023

(54) FLAT TUBE HEAT EXCHANGER WITH A SEPARATOR

(71) Applicant: ZHEJIANG SANHUA AUTOMOTIVE COMPONENTS CO., LTD., Hangzhou (CN)

(72) Inventors: Qie Shen, Hangzhou (CN); Weixin Jiang, Hangzhou (CN); Xiaohui Wu, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 0 days.

(21) Appl. No.: 17/285,377

(22) PCT Filed: Nov. 27, 2019

(86) PCT No.: PCT/CN2019/121168
§ 371 (c)(1),
(2) Date: Apr. 14, 2021

(87) PCT Pub. No.: WO2020/108513
PCT Pub. Date: Jun. 4, 2020

(65) Prior Publication Data

US 2021/0325118 A1 Oct. 21, 2021

(30) Foreign Application Priority Data

Nov. 30, 2018 (CN) ..... 201811455990.2
Nov. 30, 2018 (CN) ..... 201811455994.0
(Continued)

(51) Int. Cl.
*F28D 7/16* (2006.01)
*F28F 1/02* (2006.01)
(Continued)

(52) U.S. Cl.
CPC ..... *F28D 7/1646* (2013.01); *F28F 1/022* (2013.01); *F28F 9/0132* (2013.01);
(Continued)

(58) Field of Classification Search
CPC ..... F28F 9/0248; F28F 9/0204; F28F 1/022; F28D 7/1646
See application file for complete search history.

(56) References Cited

U.S. PATENT DOCUMENTS 5,137,082 A 8/1992 Shimoya et al.
5,765,633 A * 6/1998 Hu ..... F25B 39/04 165/173
(Continued)

FOREIGN PATENT DOCUMENTS

CN 1543560 11/2004
CN 1585879 2/2005
(Continued)

OTHER PUBLICATIONS

Translation of German Patent Document DE102014113868A1 entitled TRANSLATION-DE102014113868A1 (Year: 2015).*

*Primary Examiner* — Paul Alvare
(74) *Attorney, Agent, or Firm* — Boyle Fredrickson S.C.

(57) ABSTRACT

A heat exchange device includes a core and a housing. The core includes a first collecting part and a second collecting part, and a flat tube part is provided between the two. The flat tube part includes a first flat tube group and a second flat tube group. The first collecting part includes first and second collecting portions, and a separator is formed between the two. Each flat tube of the first flat tube group is communicated with the collecting cavity of the first collecting portion. The collecting cavity of the first collecting portion is communicated with the collecting cavity of the second collecting
(Continued)

portion through the first flat tube group, the collecting cavity of the second collecting part, and the second flat tube group.

8 Claims, 24 Drawing Sheets

(30) Foreign Application Priority Data

Nov. 30, 2018 (CN) ..... 201811456001.1
Nov. 30, 2018 (CN) ..... 201811456011.5

(51) Int. Cl.
*F28F 9/013* (2006.01)
*F28F 9/02* (2006.01)
*F28F 9/22* (2006.01)

(52) U.S. Cl.
CPC ..... *F28F 9/0248* (2013.01); *F28F 9/22* (2013.01); *F28F 2009/224* (2013.01)

(56) References Cited

U.S. PATENT DOCUMENTS

| | | | | |
|---|---|---|---|---|
| 6,155,340 | A * | 12/2000 | Folkedal | F28D 1/05383 165/173 |
| 9,410,745 | B2 | 8/2016 | Katoh et al. | |
| 2004/0194938 | A1 * | 10/2004 | Sasaki | F28D 7/0025 165/164 |
| 2004/0211551 | A1 | 10/2004 | Shinmura et al. | |
| 2004/0251013 | A1 * | 12/2004 | Kawakubo | F28F 1/022 165/172 |
| 2004/0251014 | A1 | 12/2004 | Petersen | |
| 2016/0084548 | A1 | 3/2016 | Ota et al. | |
| 2017/0158027 | A1 * | 6/2017 | Lee | F25B 39/02 |

FOREIGN PATENT DOCUMENTS

| | | | | |
|---|---|---|---|---|
| CN | 1738999 | A | 2/2006 | |
| CN | 1768244 | A | 5/2006 | |
| CN | 102095283 | A | 6/2011 | |
| CN | 105190201 | | 7/2017 | |
| CN | 107120871 | A | 9/2017 | |
| CN | 107289674 | A | 10/2017 | |
| CN | 107289677 | | 10/2017 | |
| CN | 107687726 | | 2/2018 | |
| DE | 102014113868 | A1 * | 7/2015 | F28D 21/00 |
| DE | 102015111398 | A | 4/2016 | |
| EP | 3388770 | A1 | 10/2018 | |
| FR | 3045802 | A | 6/2017 | |
| JP | 4898672 | | 3/2012 | |
| WO | WO-2009108238 | A2 * | 9/2009 | F28D 7/1661 |
| WO | 2015046660 | | 4/2015 | |
| WO | 2018024185 | A1 | 2/2018 | |

* cited by examiner

FLAT TUBE HEAT EXCHANGER WITH A SEPARATOR

CROSS-REFERENCE TO RELATED APPLICATIONS

This application is the national phase of International Patent Application No. PCT/CN2019/121168, titled "HEAT EXCHANGE DEVICE", filed on Nov. 27, 2019, which claims the benefit of priorities to the following four Chinese patent applications, all of which are incorporated herein by reference, 1) Chinese Patent Application No. 201811455994.0, titled "HEAT EXCHANGE DEVICE", filed with the China National Intellectual Property Administration on Nov. 30, 2018;

2) Chinese Patent Application No. 201811455990.2, titled "HEAT EXCHANGER", filed with the China National Intellectual Property Administration on Nov. 30, 2018;

3) Chinese Patent Application No. 201811456001.1, titled "HEAT EXCHANGE DEVICE", filed with the China National Intellectual Property Administration on Nov. 30, 2018; and 4) Chinese Patent Application No. 201811456011.5, titled "HEAT EXCHANGER ", filed with the China National Intellectual Property Administration on Nov. 30, 2018.

TECHNICAL FIELD

The present invention relates to the technical field of heat exchange devices, and in particular to a heat exchange device applicable for $CO_2$ refrigerant.

BACKGROUND OF THE INVENTION $CO_2$ is a new type of environmentally friendly refrigeration working fluid, which can reduce the global greenhouse effect and solve the problem of environmental pollution caused by chemical compounds, and has good economy and practicality.

The compression refrigeration cycle system using $CO_2$ as the working fluid can be used in most refrigeration and heating fields. However, a working pressure of this type of air conditioning system is very high, so it is required to fully consider this feature of this type of system when designing the $CO_2$ heat exchange device. Due to the immature component design, this type of system has not been widely used.

Generally speaking, $CO_2$ heat exchange devices mainly include finned tube type, micro-channel, plate type, double-pipe type and shell-and-tube type. The conventional $CO_2$ micro-channel heat exchange device utilizes forced convection between refrigerant and air to exchange heat, and the heat exchange efficiency is low. In addition, in order to meet the requirements of working pressure, the wall thickness of the parts is designed to be relatively thick, and the processing of the shell and the joint is relatively complicated.

Therefore, a problem to be solved urgently by those skilled in the art is how to improve the heat exchange device to be applicable for the air-conditioning system and the heat pump system with $CO_2$ as the working medium.

SUMMARY OF THE INVENTION

An object of the present disclosure is to provide a heat exchange device with high pressure-bearing capacity and a compact structure.

In order to achieve the above objects, a heat exchange device is provided according to the present disclosure, which includes a core and a housing, where the core includes a first flow collecting component and a second flow collecting component which are oppositely arranged, and a flat pipe component is provided between the first flow collecting component and the second flow collecting component;

the flat pipe component includes a first flat pipe group and a second flat pipe group, and the first flat pipe group and the second flat pipe group both include multiple flat pipes, and two ends of each flat pipe are respectively communicated with the first flow collecting component and the second flow collecting component;

two end portions of the housing are respectively fixedly connected to the first flow collecting component and the second flow collecting component, the flat pipe component is located in the housing, and a coolant flowing space is formed in the housing;

the second flow collecting component has a flow collecting cavity, and the flow collecting cavity of the second flow collecting component has two or more abreast flow collecting passages communicated with each other; and the first flow collecting component has a flow collecting cavity, the first flow collecting component includes a first flow collecting portion and a second flow collecting portion, and a separator is provided between the first flow collecting portion and the second flow collecting portion; each flat pipe of the first flat pipe group is communicated with the flow collecting cavity of the first flow collecting portion; each flat pipe of the second flat pipe group is communicated with the flow collecting cavity of the second flow collecting portion; the flow collecting cavity of the first flow collecting portion is communicated with the flow collecting cavity of the second flow collecting portion through the first flat pipe group, the flow collecting cavity of the second flow collecting component, and the second flat pipe group.

In the heat exchange device provided by this technical solution, the flow collecting cavity of the second flow collecting component has two or more abreast collecting flow passages communicated with each other, and two ends of each flat pipe are respectively communicated with the first flow collecting component and the second flow collecting component. During operation, a refrigerant flows from the first flow collecting portion of the first flow collecting component into the first flat pipe group of the core, and then flows into the second flat pipe group of the core after entering the second flow collecting component, and finally flows out from the second flow collecting portion of the first flow collecting component. In this process, the refrigerant exchanges heat with a coolant in the coolant flowing space in the housing. By dividing the flow collecting cavity of the second flow collecting component into multiple flow collecting passages, the multiple collecting flow passages are combined to bear a pressure from the medium together. Compared with a structure of a single inner cavity, the second flow collecting component with multiple flow collecting passages is able to enhance the pressure resistance of the heat exchange device. In addition, since a flow path of the refrigerant is divided into at least two refrigerant flow paths, the flow path of the refrigerant can be extended and the heat exchange performance can be improved.

In order to achieve the above objects, another heat exchange device is further provided according to the present disclosure, which includes a housing and a core, where the core includes a flat pipe with a circulation hole formed inside, and the flat pipe has multiple straight portions parallel to each other and bent portions that transitionally connect two adjacent straight portions, at least a part of the flat pipe is located inside the housing, a coolant flowing space is formed in the housing, the coolant flowing space is divided into at least two abreast coolant flow passages along a direction parallel to the straight portions of the flat pipe, the coolant flowing space includes the coolant flow passages, and flow directions of the two adjacent coolant flow passages are opposite to each other; the housing is provided with a hollow protrusion at the connection of the two adjacent coolant flow passages; the protrusion is located above or below the bent portions of the flat pipe, and a distance is retained between the flat pipe and an inner top or bottom surface of an inner cavity of the protrusion, and the two adjacent coolant flow passages with opposite flow directions are communicated through the inner cavity of the protrusion.

The heat exchange device provided in this technical solution includes the housing and the core, at least a part of the flat pipe of the core is located inside the housing, and the coolant flowing space inside the housing is divided into at least two coolant flow passages, and the hollow protrusion is provided on the housing, and the two adjacent coolant flow passages are communicated through the cavity of the protrusion. During operation, the coolant is first distributed to a first coolant flow passage after entering the housing, and after flowing to the opposite side, the coolant flows into a second coolant flow passage through the cavity of the protrusion, and flows out from the housing after flowing to opposite side in a reverse direction. In the flow process, the coolant exchanges heat with the refrigerant in the flat pipe. Since the coolant flowing space is divided into at least two coolant flow passages and the coolant flow passages are communicated through the cavity of the protrusion, the flow path of the coolant can be extended and the heat exchange performance can be improved.

Figure 1:
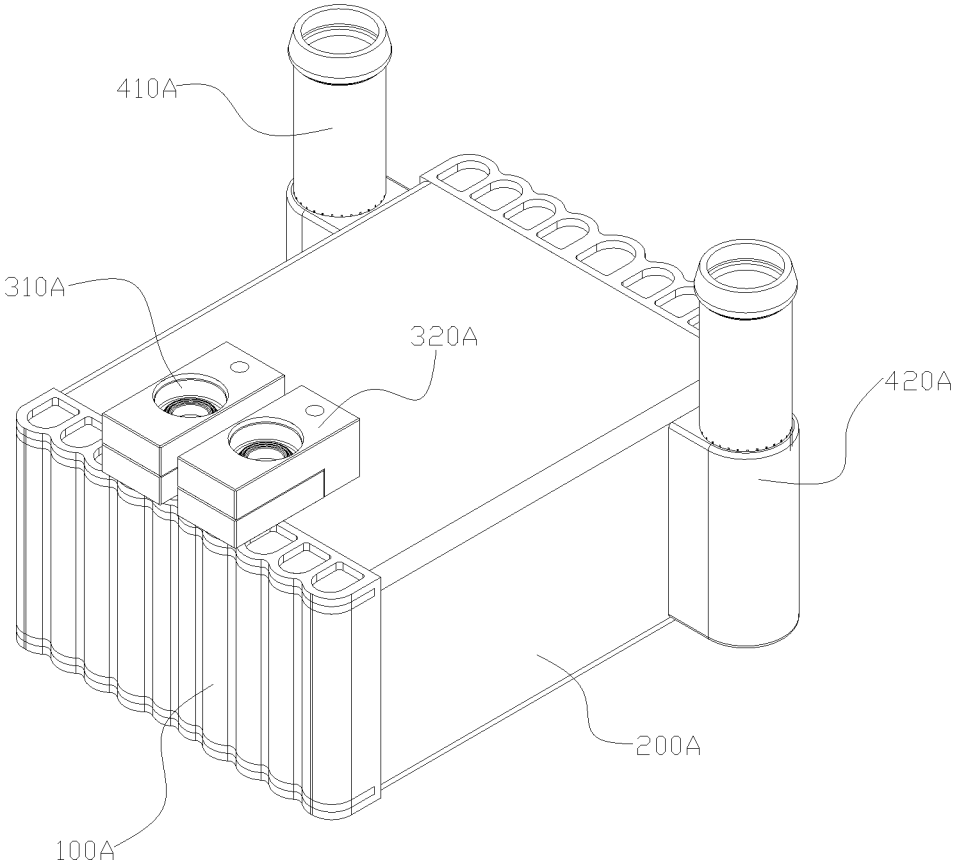
FIG. 1 is a schematic structural view of a first embodiment of a heat exchange device according to the present disclosure.

REFERENCE NUMERALS IN THE DRAWINGS 100 core, 101A first fluid port,
102A second fluid port;
110A-1 first flow collecting component,
110A-2 second flow collecting component,
111A first wall portion, 112A second wall portion,
1121A insertion hole, 113A side plate portion,
114A-1 first end plate, 114A-2 second end plate,
115A sealing groove, 116A partition plate,
1101A flow collecting passage;
120A-1 first flat pipe group, 120A-2 second flat pipe group,
121A flat pipe, 1211A circulation hole;
200A housing, 210A coolant port;
310A first port seat, 311A first pipe-connecting seat,
312A first adapter seat, 320A second port seat,
321A second pipe-connecting seat,
322A second adapter seat;
410A first coolant pipe-connecting component,
411A first pipe-connecting seat body,
412A first connecting pipe,
420A second coolant pipe-connecting component,
421A second pipe-connecting seat body,
422A second connecting pipe;
500A baffle plate;
100B core, 101B first fluid port,
102B second fluid port;
110B-1 first flow collecting component,
110B-2 second flow collecting component,
111B first wall portion, 1111B notch,
112B second wall portion, 1121B insertion hole,
113B separator, 114B-1 first end plate,
114B-2 second end plate, 115B sealing groove,
1101B flow collecting passage;
120B-1 first flat pipe group, 120B-2 second flat pipe group,
121B flat pipe;
200B housing, 210B coolant port;
310B first port seat, 320B second port seat;
410B first coolant pipe-connecting component,
411B first pipe-connecting seat,
412B first connecting pipe,
420B second coolant pipe-connecting component,
421B second pipe-connecting seat,
422B second connecting pipe;
500B baffle plate;
100C core, 101C first fluid port,
102C second fluid port;
110C-1 first flow collecting component,
110C-11 first flow collecting portion,
110C-12 second flow collecting portion,
110C-2 second flow collecting component,
1101C flow collecting passage,
1121C insertion hole, 113C separator,
114C-1 first end plate, 114C-2 second end plate,
1141C outer semicircular portion,
1142C inner semicircular portion,
115C-1 first end sealing groove,
115C-2 second end sealing groove,
116C flow path separation groove;
120C flat pipe component, 120C-1 first flat pipe group,
120C-2 second flat pipe group, 1211C circulation hole;
200C housing, 210C first orifice,
220C second orifice, 230C third orifice;
310C first port seat, 320C second port seat;
410C coolant inlet, 420C coolant outlet,
430C bridge region, 440C distribution region,
450C collecting region,
510C first adapter block, 520C second adapter block,
521C separation rib;
610C refrigerant flow passage, 620C fin (simplified representation);
100D core, 101D refrigerant inlet,
102D refrigerant outlet;
110D inlet first flow collecting structure,
120D outlet second flow collecting structure, -continued 121D flat pipe, 1211D circulation hole,
1212D straight portion, 1213D bent portion,
200D housing, 210D upper housing,
211D outer flange, 212D serrated protrusion,
220D lower housing, 230D installation plate,
231D installation hole, 240D flange plate,
241D oblong counterbore, 242D notch,
250D protrusion, 251D inner top surface,
252D inner cavity,
310D refrigerant inlet connecting seat,
320D refrigerant outlet connecting seat,
330D channel;
410D coolant inlet, 420D coolant outlet;
500D baffle plate, 510D flange;
620D fin (simplified representation).

DESCRIPTION OF THE EMBODIMENTS

In order to enable those skilled in the art to better understand the technical solutions of the present disclosure, the present disclosure will be further described in detail with reference to the drawings and embodiments.

Embodiment 1

Figure 2:
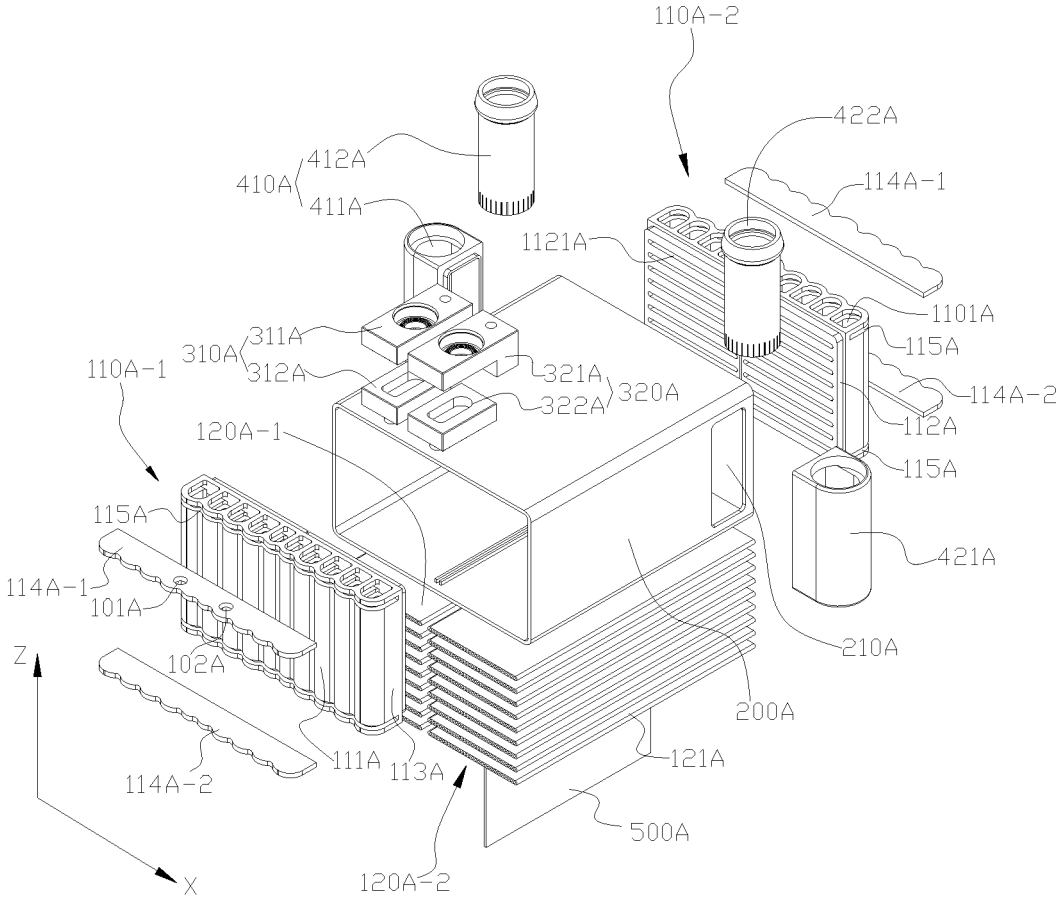
FIG. 2 is an exploded view of the heat exchange device shown in FIG. 1.
Figure 3:
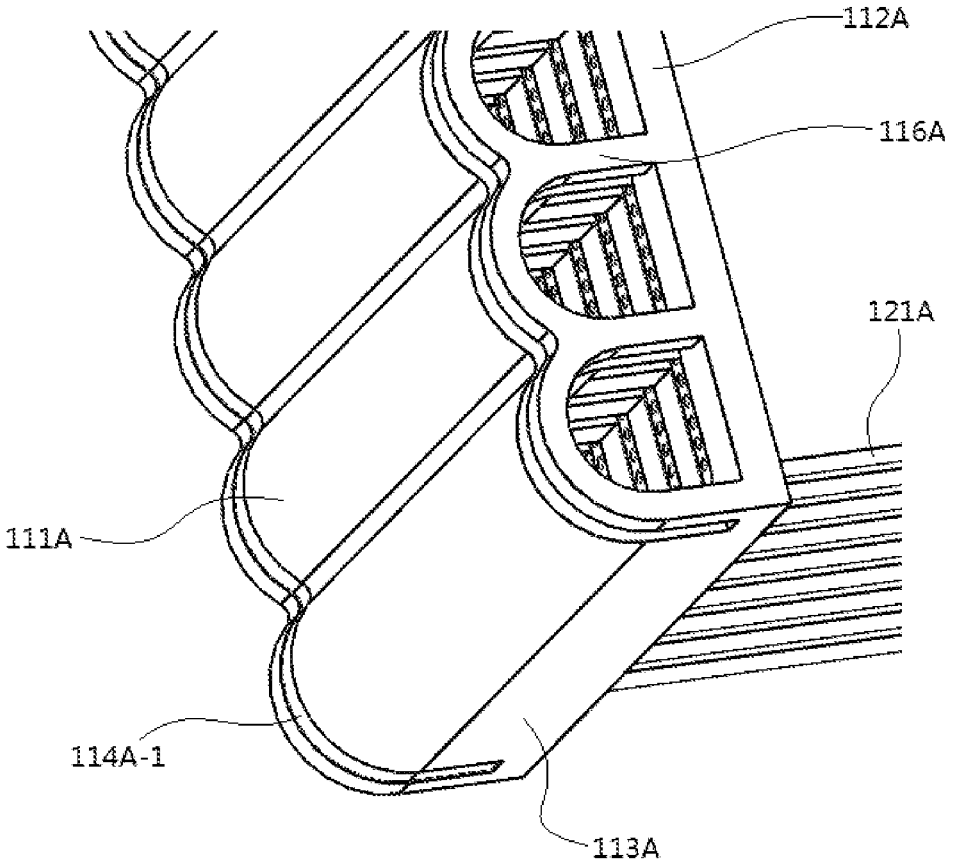
FIG. 3 is a schematic view of the internal structure of a flat pipe component connected to a flow collecting component in the first embodiment.
Figure 4:
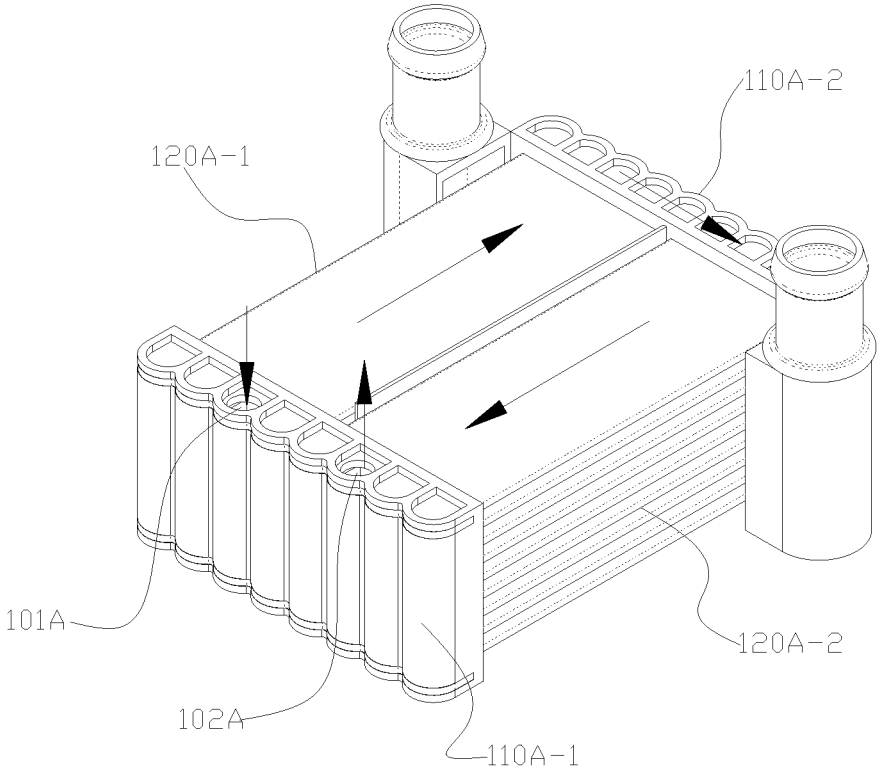
FIG. 4 is a schematic structural view of a core of the heat device shown in FIG. 1, and the arrow in the figure indicates the flow direction of the refrigerant.
Figure 5:
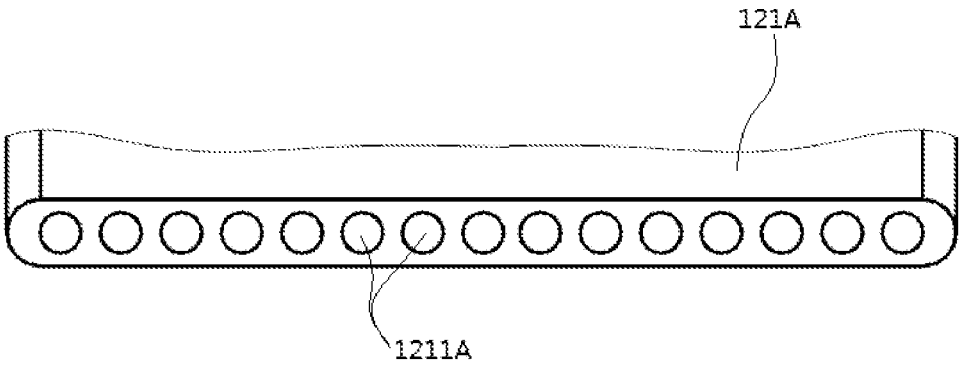
FIG. 5 is a schematic structural view of a flat pipe in a specific embodiment.

Referring to FIGS. 1 to 5, FIG. 1 is a schematic structural view of a first embodiment of a heat exchange device according to the present disclosure; FIG. 2 is an exploded view of the heat exchange device shown in FIG. 1; FIG. 3 is a schematic view of the internal structure of a flat pipe component connected to a flow collecting component in the first embodiment; FIG. 4 is a schematic structural view of a core of the heat device shown in FIG. 1; and FIG. 5 is a schematic structural view of a flat pipe in a specific embodiment.

In this embodiment, the heat exchange device includes a core 100A and a housing 200A.

The core 100A includes two abreast flow collecting components, and a flat pipe component is provided between the two flow collecting components. For the convenience of description and understanding below, the two flow collecting components are respectively referred to as a first flow collecting component 110A-1 and a second flow collecting component 110A-2.

The flat pipe component includes multiple flat pipes 121A, and two ends of each flat pipe 121A are respectively communicated with the first flow collecting component 110A-1 and the second flow collecting component 110A-2.

The housing 200A is sleeved outside the core 100A. Specifically, two end portions of the housing 200A are respectively fixedly connected to the first flow collecting component 110A-1 and the second flow collecting component 110A-2, the flat pipe component is located inside the housing 200A, and a coolant flowing space is formed between the housing 200A and the core 100A. It is conceivable that the coolant flowing space is actually a space formed between the housing 200A and the flat pipes 121A.

Flow passages communicating inside the flat pipes 121A of the core 100A is a refrigerant flowing space.

The first flow collecting component 110A-1 has a flow collecting cavity, the first flow collecting component 110A-1 includes a first flow collecting portion and a second flow collecting portion, and a separator is provided between the first flow collecting portion and the second flow collecting portion, so that the flow collecting cavity of the first flow collecting portion and the flow collecting cavity of the second flow collecting portion are not communicated with each other; a part of the flat pipes 121A of the flat pipe component are configured to communicate the flow collecting cavity of the first flow collecting portion with the flow collecting cavity of the second flow collecting component 110A-2, and the other part of the flat pipes 121A are configured to communicate the flow collecting cavity of the second flow collecting portion with the flow collecting cavity of the second flow collecting component 110A-2. In other words, the flow collecting cavity of the first flow collecting portion is communicated with the flow collecting cavity of the second flow collecting portion through a part of the flat pipes 121A, the flow collecting cavity of the second flow collecting component 110A-2, and the other part of the flat pipes 121A.

The second flow collecting component 110A-2 has a flow collecting cavity, and the flow collecting cavity of the second flow collecting component 110A-2 has two or more abreast flow collecting passages 1101A communicated with each other.

As above, in the heat exchange device, the flow collecting cavity of the second flow collecting component 110A-2 is designed in a form of two or more abreast flow collecting passages 1101A communicated with each other, and the first flow collecting component 110A-1 is designed in a form of two abreast flow collecting portions not communicated with each other, so that wall portions forming the flow collecting passages 1101A are configured to bear pressure, and, for a collecting component with the same size, can improve the pressure-bearing capacity. Besides, the first flow collecting portion is communicated with the second flow collecting portion through the flat pipes 121A corresponding to the first flow collecting portion, the second flow collecting component, and the flat pipes 121A corresponding to the second flow collecting portion, which can increase the flow path of the refrigerant such as $CO_2$, thereby improving the heat exchange performance.

In this embodiment, the structures of the main parts of the first flow collecting component 110A-1 and the second flow collecting component 110A-2 are basically the same. For the conciseness of description, the following gives unified description for the same structures of the two, and gives separate description for the differences between the two.

In a specific solution, the flow collecting component includes a main body component, a first end plate 114A-1 and a second end plate 114A-2, the flow collecting cavity of the flow collecting component is located in the main body component, and the first end plate 114A-1 and the second end plate 114A-2 block two ends of the flow collecting cavity of the flow collecting component.

For ease of description, referring to FIG. 2, the X-axis direction in the figure is defined as the length direction of the flow collecting component, and the Z-axis direction in the figure is defined the width direction of the flow collecting component.

Specifically, the main body component includes a first wall portion 111A, a second wall portion 112A and two side plate portions 113A. The first wall portion 111A and the second wall portion 112A are arranged opposite to each other, two ends of the first wall portion 111A and the second wall portion 112A are respectively connected through the two side plate portions 113A, so that the first wall portion 111A, the second wall portion 112A and two side plate portions 113A form the main body component of the flow collecting component. In the width direction of the flow collecting component, two ends of the main body component are open, and the first end plate 114A-1 and the second end plate 114A-2 are configured to block the two open ends of the main body component.

In this solution, the first wall portion 111A is relatively away from the flat pipes 121A, and the second wall portion 112A is relatively close to the flat pipes 121A.

In this embodiment, for the first flow collecting component 110A-1, an inner wall of the first wall portion 111A is provided with a separator extending toward the second wall portion 112A and abutting against the second wall portion 112A, and the separator divides the first flow collecting component 110A-1 into the first flow collecting portion and the second flow collecting portion. It is conceivable that, in actual arrangement, the separator may have an integral structure with the main body component of the first flow collecting component 110A-1, or the separator may be separately provided, and the separator is fixedly connected to the main body component of the first flow collecting component 110A-1.

In this embodiment, for the second flow collecting component 110A-2, the inner wall of the first wall portion 111A is provided with at least one partition plate 116A extending toward the second wall portion 112A, and the flow collecting cavity of the second flow collecting component 110A-2 is divided into two or more abreast flow collecting passages 1101A communicated with each other through the partition plate 116A.

In the illustrated solution, the axis of each flow collecting passage 1101A of the second flow collecting component 110A-2 is perpendicular to the length direction of the second flow collecting component 110A-2, that is, the flow collecting passages 1101A of the second flow collecting component 110A-2 are arranged along the length direction of the second flow collecting component 110A-2. It is conceivable that, correspondingly, the partition plates 116A are arranged along the length direction of the second flow collecting component 110A-2, so that the axis of the flow collecting passage 1101A formed by separation is perpendicular to the length direction of the second flow collecting component 110A-2. It is conceivable that, in actual arrangement, the axis of each flow collecting passage 1101A of the second flow collecting component 110A-2 may not be perpendicular to the length direction of the second flow collecting component 110A-2.

In a further solution, the flow collecting cavity of the first flow collecting portion of the first flow collecting component 110A-1 has two or more abreast flow collecting passages 1101A communicated with each other, and the flow collecting cavity of the second flow collecting portion of the first flow collecting component 110A-1 has two or more abreast flow collecting passages 1101A communicated with each other.

Specifically, the inner wall, corresponding to the first flow collecting portion, of the first wall portion 111A of the first flow collecting component 110A-1 is provided with at least one partition plate 116A extending toward the second wall portion 112A, so that the flow collecting cavity of the first flow collecting portion is divided into two or more flow collecting passages 1101A through the partition plate 116A. Similarly, the inner wall, corresponding to the second flow collecting portion, of the first wall portion 111A of the first flow collecting component 110A-1 is provided with at least one partition plate 116A extending toward the second wall portion 112A, so that the flow collecting cavity of the second flow collecting portion is divided into two or more flow collecting passages 1101A through the partition plate 116A.

In the illustrated solution, the axis of each flow collecting passage 1101A of the first flow collecting component 110A-1 is perpendicular to a length direction of the first flow collecting component 110A-1. Apparently, in actual arrangement, the axis of each flow collecting passage 1101A of the first flow collecting component 110A-1 may not be perpendicular to the length direction of the first flow collecting component 110A-1.

The second wall portion 112A of the flow collecting component has multiple insertion holes 1121A adapted to the flat pipes 121A. Specifically, two ends of each flat pipe 121A are respectively inserted into the two second wall portions 112A of the two flow collecting components. In this way, the collecting cavities of the two flow collecting components are communicated through the flat pipes 121A.

In a specific solution, in order to ensure the communication between the flow collecting passages 1101A, the partition plate 116A as a whole may be kept at a certain distance from the second wall portion 112A. Apparently, a groove structure or a notch may be provided at an inner end of the partition plate 116A. In this way, the partition plate 116A is able to abut against the second wall portion 112A, and two adjacent flow collecting passages 1101A separated by the partition plate 116A are communicated through the groove structure or the notch. Alternatively, the partition plate 116A may be provided with a through hole structure, so that the partition plate 116A is able to abut against the second wall portion 112A, and two adjacent flow collecting passages 1101A separated by the partition plate 116A are communicated through the through hole structure.

In a specific solution, the multiple flat pipes 121A corresponding to the first flow collecting portion of the first flow collecting component 110A-1 form at least one flat pipe group, and the multiple flat pipes 121A corresponding to the second flow collecting portion of the first flow collecting component 110A-1 also form at least one flat pipe group. The multiple flat pipes 121A of each flat pipe group are stacked along the width direction of the flow collecting component, and each flat pipe group is arranged along the length direction of the flow collecting component.

As shown in the figure, in the illustrated solution, along the X-axis direction, the multiple flat pipes 121A of the flat pipe component are only divided into two flat pipe groups, namely a first flat pipe group 120A-1 and a second flat pipe group 120A-2. The flat pipes 121A of the first flat pipe group 120A-1 are configured to communicate the flow collecting cavity of the first flow collecting portion of the first flow collecting component 110A-1 with the flow collecting cavity of the second flow collecting component 110A-2, and the flat pipes 121A of the second flat pipe group 120A-2 are configured to communicate the flow collecting cavity of the second flow collecting portion of the first flow collecting component 110A-1 with the flow collecting cavity of the second flow collecting component 110A-2. In other words, the flow collecting cavity of the first flow collecting portion is communicated with the flow collecting cavity of the second flow collecting portion through the first flat pipe group 120A-1, the flow collecting cavity of the second flow collecting component 110A-2, and the second flat pipe group 120A-2.

Correspondingly, the second wall portion 112A of the flow collecting component is provided with two insertion hole groups, and the two insertion hole groups correspond to the first flat pipe group 120A-1 and the second flat pipe group 120A-2 respectively. Multiple insertion holes 1121A of each insertion hole group are arranged along the Z-axis direction, and the number of insertion holes 1121A of each insertion hole group correspond to the number of the flat pipes 121A of the corresponding flat pipe group.

In this embodiment, on the basis that the first flow collecting component 110A-1 is divided into the first flow collecting portion and the second flow collecting portion, the first end plate 114A-1 of the first flow collecting component 110A-1 is provided with a first fluid port 101A and a second fluid port 102A, where the first fluid port 101A is communicated with the flow collecting cavity of the first flow collecting portion, and the second fluid port 102A is communicated with the flow collecting cavity of the second flow collecting portion.

Referring to FIG. 4, as shown in the figure, the fluid port on the left side of the first end plate 114A-1 is the first fluid port 101A. Correspondingly, the left portion of the first flow collecting component 110A-1 is the first flow collecting portion. The fluid port on the right side of the first end plate 114A-1 is the second fluid port 102A. Correspondingly, the right portion of the first flow collecting component 110A-1 is the second flow collecting portion.

In the figure, by way of example that the first fluid port 101A on the left side is the refrigerant inlet and the second fluid port 102A on the right side is the refrigerant outlet to illustrate the flow passage of the refrigerant, arrows in FIG. 4 indicate the flow direction of the refrigerant.

After the refrigerant flows from the first fluid port 101A into the flow collecting cavity of the first flow collecting portion of the first flow collecting component 110A-1, due to the separation by the separator in the first flow collecting component 110A-1, the refrigerant can only flow into the flow collecting cavity of the second flow collecting component 110A-2 through the flat pipes 121A of the first flat pipe group 120A-1. Since there is no separator in the flow collecting cavity of the second flow collecting component 110A-2, the refrigerant flows into the flow collecting cavity of the second flow collecting component 110A-2, and then flows into the flow collecting cavity of the second flow collecting portion of the first flow collecting component 110A-1 though the flat pipes 121A of the second flat pipe group 120A-2, and finally flows out from the second fluid port 102A.

In the specific arrangement, the separator may be arranged in the middle of the first flow collecting component 110A-1, to symmetrically separate the flow collecting cavity of the first flow collecting component 110A-1. Apparently, the separator may not be arranged in the middle of the first flow collecting component 110A-1 according to requirements, and the lengths of the separated first flow collecting portion and second flow collecting portion may be different.

In the specific arrangement, the first flow collecting portion and the second flow collecting portion may both be provided with two or more flat pipe groups, the flow collecting portions may have different number of corresponding flat pipe groups, and the flat pipe groups may have the same number or different number of flat pipes 121A, which may be specifically determined according to requirements and actual conditions.

In a specific solution, the number of the flow collecting passages 1101A of the first flow collecting component 110A-1 is the same as the number of the flow collecting passages 1101A of the second flow collecting component 110A-2. The number of the flow collecting passages 1101A of each flow collecting component may be designed according to needs, for example, preferably 2 to 10. In this embodiment, since the flow collecting passages 1101A are arranged along the length direction of the flow collecting component, the number of the flow collecting passages 1101A is designed to be relatively large. Apparently, in practice, the number of the flowing passages may be determined in combination with actual requirements such as specific size of the flow collecting component and the specific type of the refrigerant.

In a further solution, the first wall portion 111A of the flow collecting component includes two or more curve portions protruding outward. A smooth transition is provided between two adjacent curve portions, and the partition plate 116A is arranged between the two adjacent curve portions. With this design, each curve portion forms an outer side wall surface of the flow collecting passage 1101A. This structure is able to further improve the pressure-bearing capacity of each flow collecting passage 1101A, thereby improving the pressure-bearing capacity of the flow collecting component under the same size, which enables the core 100A to be applicable for the refrigerant with a high requirement on the pressure resistance, such as $CO_2$.

Specifically, each curve portion of the first wall portion 111A has an arc-shaped structure, preferably a semicircular arc which has a symmetrical structure, is easy to process and is more conducive to improving the pressure-bearing capacity.

In a specific solution, the first wall portion 111A, the two side plate portions 113A, and the partition plate 116A of the flow collecting component have an integral structure, to reduce connection points of the flow collecting component and ensure the strength of the flow collecting component.

More specifically, if the processing conditions permit, the first wall portion 111A, the two side plate portions 113A, the partition plate 116A, and the second wall portion 112A of the flow collecting component are arranged as an integral structure.

In a specific solution, an equivalent diameter of the cross section of each flow collecting passage 1101A of the flow collecting component may range from 5 mm to 25 mm. It is apparent that the equivalent diameter may have other values according to requirements in practice.

In this embodiment, the outer wall of the flow collecting passage 1101A has an arc-shaped structure. In actual arrangement, the cross section of the flow collecting passage 1101A may be substantially circular, oblong or oval.

Referring to FIG. 2, it is conceivable that the first wall portion 111A, the two side plate portions 113A, and the second wall portion 112A of the flow collecting component form the main body component of the flow collecting component. In a specific solution, sealing grooves 115A with outward openings are respectively provided at positions close to two ends of the main body component, the shapes of the first end plate 114A-1 and the second end plate 114A-2 match the sealing grooves 115A, and the first end plate 114A-1 and the second end plate 114A-2 are inserted into the sealing grooves 115A and the corresponding connection portions are sealed.

As above, the first end plate 114A-1 and the second end plate 114A-2 block the openings of the flow collecting component by inserting, which can improve the reliability of the connection between the first end plate 114A-1 and the main body component of the flow collecting component and the connection between the second end plate 114A-2 and the main body component of the flow collecting component. Compared with the method of directly blocking the open end surface, this method is able to bear greater pressure and further improve the pressure-bearing capacity of the flow collecting component.

Taking the illustrated solution as an example, the first fluid port 101A and the second fluid port 102A are both formed on the first end plate 114A-1 of the first flow collecting component 110A-1. Apparently, the first fluid port 101A and the second fluid port 102A are separately provided on two sides of the separator inside the first flow collecting component 110A-1.

As shown in FIGS. 1 and 2, the first fluid port 101A and the second fluid port 102A are both formed on a same end plate, that is, the first end plate 114A-1. It is conceivable that, in practical arrangement, the two fluid ports may be respectively formed on the two end plates of the first flow collecting component 110A-1.

In this embodiment, the heat exchange device further includes fluid port seat components to facilitate the installation of pipe fittings communicating with the fluid ports.

Still taking FIGS. 1 and 2 as an example, the heat exchange device further includes a first port seat 310A and a second port seat 320A, which respectively cooperate with the first fluid port 101A and the second fluid port 102A.

Specifically, the first port seat 310A includes a first adapter seat 312A and a first pipe-connecting seat 311A. The first adapter seat 312A is connected to the housing 200A and the first flow collecting component 110A-1 and has a through hole communicated with the first fluid port 101A. The first pipe-connecting seat 311A is snapped to the first adapter seat 312A and fixed thereto by welding, and has a first port for mating with a connecting pipe. The first port is communicated with the through hole of the first adapter seat 312A, to enable the connecting pipe inserted thereto to communicate with the first fluid port 101A. In other words, the first connecting seat 311A is fixed to the first end plate 114A-1 through the first adapter seat 312A, and the first port of the first connecting seat 311A is communicated with the flow collecting cavity of the first flow collecting portion through the first fluid port 101A.

The second port seat 320A is similar in structure to the first port seat 310A, and includes a second adapter seat 322A and a second pipe-connecting seat 321A. The second pipe-connecting seat 321A is provided with a second port, the second pipe-connecting seat 321A is fixed to the first end plate 114A-1 through the second adapter seat 322A, and the second port is communicated with the flow collecting cavity of the second flow collecting portion through the second fluid port 102A.

In this embodiment, each flat pipe 121A of the flat pipe component has two or more circulation holes 1211A. As shown in FIG. 5, each circulation hole 1211A is arranged along the width direction of the flat pipe, that is, one flat pipe 121A is communicated with the two flow collecting components through two or more circulation holes 1211A therein. In this way, a circulation cavity of each flat pipe 121A is divided into two or more independent circulation holes 1211A, so that the hole wall forming each circulation hole 1211A bears the pressure of the fluid in the hole. For flat pipes of the same size, the pressure-bearing capacity of the flat pipe 121A can be improved, and increase of the size of the flat pipe 121A can be avoided, which further provides favorable conditions for the lightweight and miniaturized design of the core 100A.

Combined with the structure of the above flow collecting component, the structure design of the core 100A is applicable for refrigerants such as $CO_2$ and the like without increasing the size, which not only meets the environmental protection requirements, but also meets the development requirements of lightweight of automobiles.

In the illustrated solution, the circulation hole 1211A of the flat pipe 121A is circular. It is conceivable that, in practical arrangement, the circulation hole 1211A may have other shapes such as an ellipse or a polygon.

Specifically, an equivalent aperture of the circulation hole 1211A may range from 0.3 mm to 1.5 mm, and a distance between the centers of two adjacent circulation holes is preferably 0.5 mm to 2.5 mm.

The specific structure of the core 100A of the heat exchange device is described above in detail, and the detailed structure of the refrigerant flowing space is described. The following describes the coolant flowing space.

As described above, the coolant flowing space is formed between the housing 200A and the core 100A.

Referring to FIGS. 1 and 2, in this embodiment, the housing 200A has an integral structure, and is specifically formed by connecting four housing walls sequentially. For ease of description, two housing walls arranged along the X-axis direction are referred to as side walls of the housing 200A, and two housing walls arranged along the Z-axis direction are referred to as a top wall and a bottom wall of the housing 200A respectively. The top wall is the upper housing wall in the figure, and the bottom wall is the lower housing wall in the figure.

It is conceivable that, since the coolant flowing space is formed between the housing 200A and the core 100A, the connection between the housing 200A and the core 100A is sealed. Specifically, the flat pipe component of the core 100A is located inside the housing 200A, and two end surfaces of the housing 200A are connected to the second wall portions 112A of the two flow collecting components of the core 100A.

In this embodiment, one or more baffle plate 500A is provided in the housing 200A, and one end of the baffle plate 500A is kept at a predetermined distance from one of the first flow collecting component 110A-1 and the second flow collecting component 110A-2. Another end of the baffle plate 500A is fixed to the other one of the first flow collecting component 110A-1 and the second flow collecting component 110A-2. Two side portions of the baffle plate 500A are fixed to an inner wall of the housing 200A, to divide the coolant flowing space into two or more abreast coolant flow passages communicated with each other, and the two or more coolant flow passages are such configured that two adjacent coolant flow passages are separated at one end and are communicated at another end.

The coolant flow passages are parallel to the circulation passages between the first flow collecting portion and the second flow collecting component 110A-2 of the core 100A, and are parallel to the circulation passages between the second flow collecting portion and the second flow collecting component 110A-2, to facilitate the heat exchange between the coolant flowing in the coolant flow passages and the refrigerant flowing in the circulation passages.

The housing 200A has two coolant ports 210A, which are respectively communicated with the two coolant flow passages located outside.

It is conceivable that, with the above arrangement, the coolant flowing in from one coolant port 210A is able to flow through the coolant flow passages in sequence and then flow out from the other coolant port 210A, that is, the flow path of the coolant in the coolant flowing space is similar to a serpentine.

The heat exchange device further includes a first coolant pipe-connecting component 410A and a second coolant pipe-connecting component 420A, which respectively cooperate with the two coolant ports 210A to facilitate connection with the coolant pipes.

Specifically, the first coolant pipe-connecting component 410A includes a first pipe-connecting seat body 411A and a first connecting pipe 412A. The first pipe-connecting seat body 411A has a communication port communicating with an inner cavity of the first pipe-connecting seat body. The first pipe-connecting seat body 411A is connected to the side wall of the housing 200A, and after the connection, the communication port is communicated with the coolant port 210A. The first connecting pipe 412A is fixedly inserted in the first pipe-connecting seat body 411A, and the first connecting pipe 412A is communicated with the inner cavity of the first pipe-connecting seat body 411A, so that the first connecting pipe is communicated with the coolant port 210A through the communication port.

The second coolant pipe-connecting component 420A has a similar structure to the first coolant pipe-connecting component 410A, and includes a second pipe-connecting seat body 421A and a second connecting pipe 422A. The specific structure and connection method are similar to those of the first coolant pipe-connecting component 410A and will not be repeated here.

For ease of understanding, take the solution shown in FIG. 2 as an example, only one baffle plate 500A is provided in the housing 200A, and the baffle plate 500A divides the coolant flowing space into two coolant flow passages.

Figure 4A:
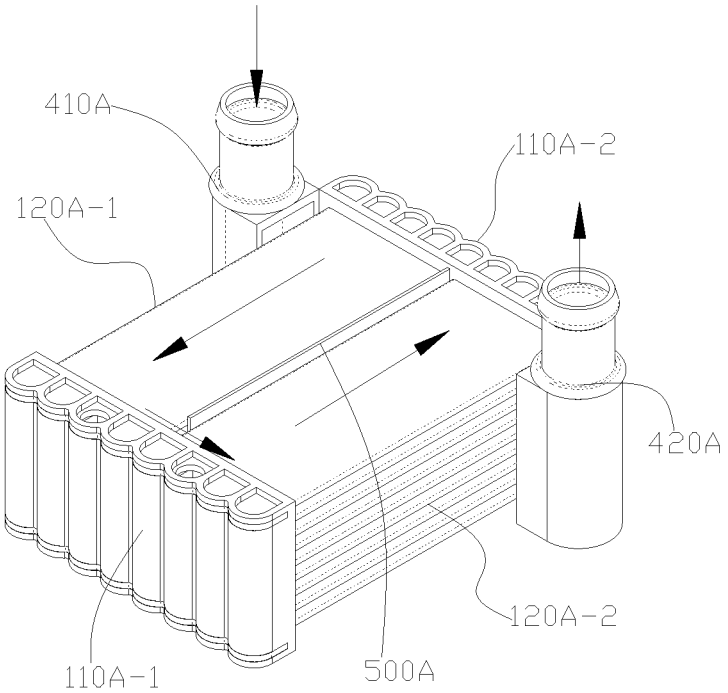
FIG. 4A is a schematic structural view of the core of the heat device shown in FIG. 1, and the arrow in the figure indicates the flow direction of the coolant.

Referring to FIG. 4A, FIG. 4A is a schematic structural view of the core of the heat device, which further shows the structure of the coolant pipe-connecting component, so as to facilitate the description of the location and the flow path of the coolant port.

In this embodiment, the flat pipes 121A of each flat pipe group are arranged along the Z-axis direction. Therefore, the baffle plate 500A arranged in the housing 200A can only be located between two adjacent flat pipe groups, as shown in the solution of FIGS. 2 and 4A. On the basis that the first flow collecting component 110A-1 of the core 100A is divided into the first flow collecting portion and the second flow collecting portion, it is conceivable that the two flow collecting portions correspond to the two coolant flow passages in positions.

In this embodiment, since the flat pipes 121A are arranged along the Z-axis direction, in order to facilitate the flow of the coolant in the flat pipes 121A, the two coolant ports 210A are respectively formed on the two side walls of the housing 200A, that is, after the flowing into the housing 200A from one coolant port 210A, the coolant can directly flow between the flat pipes 121A, which facilitates the flow of the coolant in the coolant flow passages.

On the basis of arranging two coolant flow passages, it is conceivable the two coolant ports 210A are located at a same end of the housing 200A.

In the illustrated solution, the two coolant ports 210A are provided at one end of the housing 200A close to the second flow collecting component 110A-2. On this basis, one end of the baffle plate 500A located inside the housing 200A abuts against the second flow collecting component 110A-2, so that the two coolant flow passages are separated on the side where the second flow collecting component 110A-2 is located, to prevent the coolant flowing in from one coolant port 210A directly flows out from the other coolant port 210A without passing through the coolant flow passages. Correspondingly, another end of the baffle plate 500A is kept at a predetermined distance from the first flow collecting component 110A-1, so that the two coolant flow passages are communicated on the side where the first flow collecting component 110A-1 is located.

It is conceivable that the upper and lower ends of the baffle plate 500A abut against the top wall and the bottom wall of the housing 200A respectively, so that the two coolant flow passages are communicated only on the side where the first flow collecting component 110A-1 is located.

In a specific solution, positioning grooves adapted to the baffle plate 500A may be provided at the corresponding positions of the bottom wall and the top wall of the housing 200A, to facilitate the installation of the baffle plate 500A to the housing 200A.

Specifically, the bottom wall or the top wall of the housing 200A may be fixedly connected with two parallel protruding strips at appropriate positions, and the positioning groove adapted to the baffle plate 500A is formed between the two protruding strips.

In practical arrangement, the baffle plate 500A may abut against the first flow collecting component 110A-1, and be provided with a notch structure or a through hole structure at an end close to the first flow collecting component 110A-1. The two coolant flow passages are communicated on the side where the first flow collecting component 110A-1 is located through the notch structure or the through hole structure.

In the orientation shown in FIG. 4A, assuming that the first coolant pipe-connecting component 410A is a coolant inlet pipe and the second coolant pipe-connecting component 420A is a coolant outlet pipe, the flow path of the coolant in the heat exchange device is that:

the coolant in the first coolant pipe-connecting component 410A flows into the housing 200A through the corresponding coolant port 210A, and then flows directly between the flat pipes 121A of the first flat pipe group 120A-1, and due to the separation effect of the baffle plate 500A, the coolant can only flow from the second flow collecting component 110A-2 to the first flow collecting component 110A-1 along the coolant flow passages on the left side of the baffle plate 500A. When the coolant flows to the position of the first flow collecting component 110A-1, due to the predetermined distance between the baffle plate 500A and the first flow collecting component 110A-1, the coolant is able to flow from the left side to the right side of the baffle plate 500A, and flows from the first flow collecting component 110A-1 to the second flow collecting component 110A-2 along the coolant flow passages on the right side of the baffle plate 500A. When the coolant flows to the position of the second flow collecting component 110A-2, due to the separation effect of the baffle plate 500A, the coolant is able to flow out of the second coolant pipe-connecting component 420A through the coolant port 210A at the corresponding position.

Taking the examples shown in FIGS. 4 and 4A, in the corresponding refrigerant flow passage and coolant flow passage, the flow direction of the refrigerant is opposite to the flow direction of the coolant. It is conceivable that, in practical arrangement, the flow direction of the refrigerant may be the same as that of the coolant by changing the inlet and the outlet.

It should be noted herein that, in the above embodiment, two coolant flow passage are provided, but in practical arrangement, three or other numbers of coolant flow passages may be provided.

In a specific solution, the heat exchange device further includes multiple fins arranged in the housing 200A, and the fins are located between two adjacent flat pipes 121A, or between the flat pipe 121A and the housing 200A, so as to enhance heat exchange.

Specifically, the fin may have a continuous corrugated structure or a square wave structure to increase the heat exchange area.

Specifically, the extension direction of the fins may be consistent with the length direction of the flat pipes 121A, or perpendicular to the length direction of the flat pipes 121A, or in other forms. Two adjacent fins may be staggered. Different arrangement methods of the fins affect the effect of the heat exchange, and the arrangement method of the fins may be determined according to specific requirements in practice.

Specifically, structures such as bumps or ribs may be provided on the surface of the fin to enhance the effect of the heat exchange.

Embodiment 2

Figure 6:
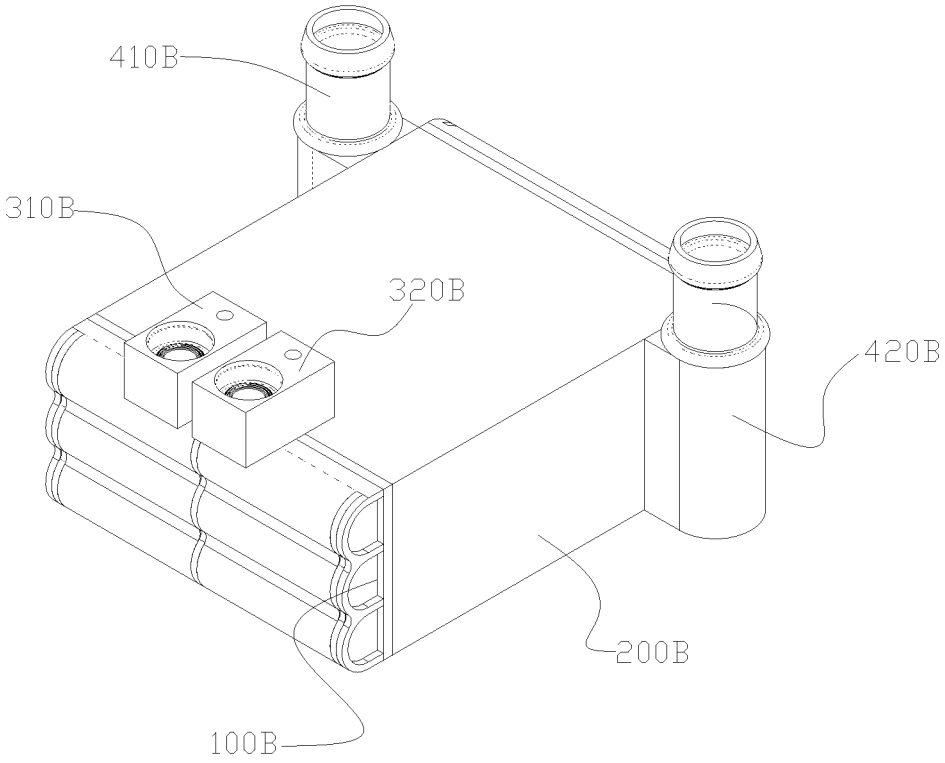
FIG. 6 is a schematic structural view of a second embodiment of the heat exchange device according to the present disclosure.
Figure 7:
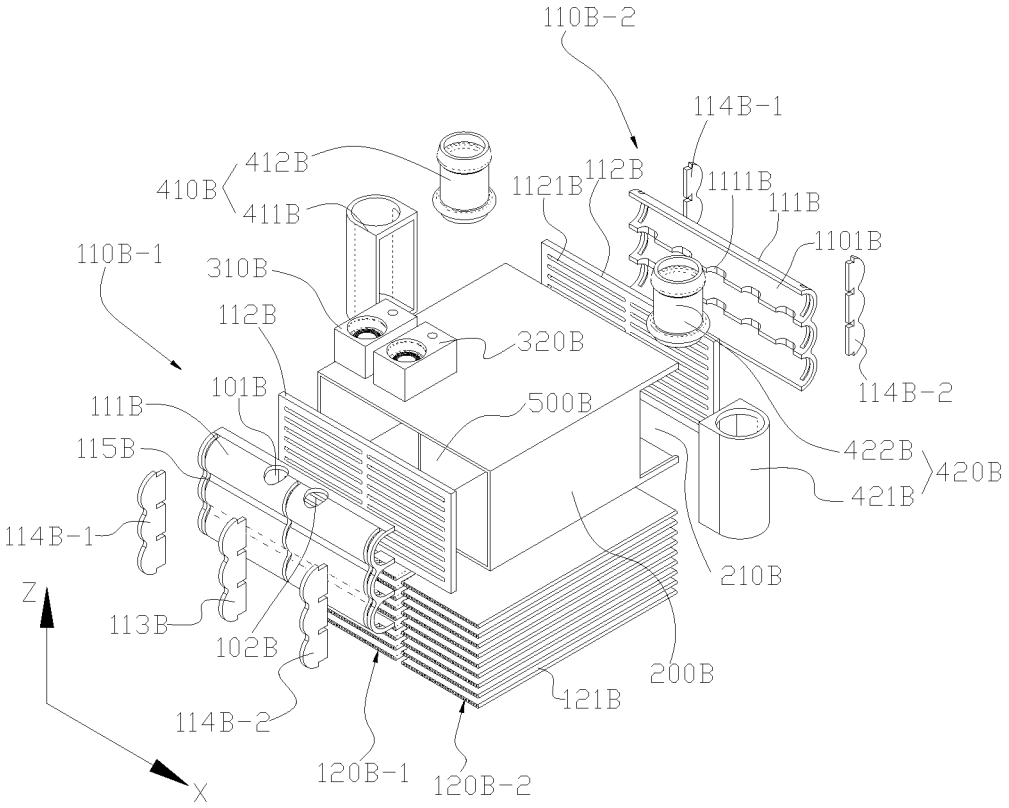
FIG. 7 is an exploded view of the heat exchange device shown in FIG. 6.
Figure 8:
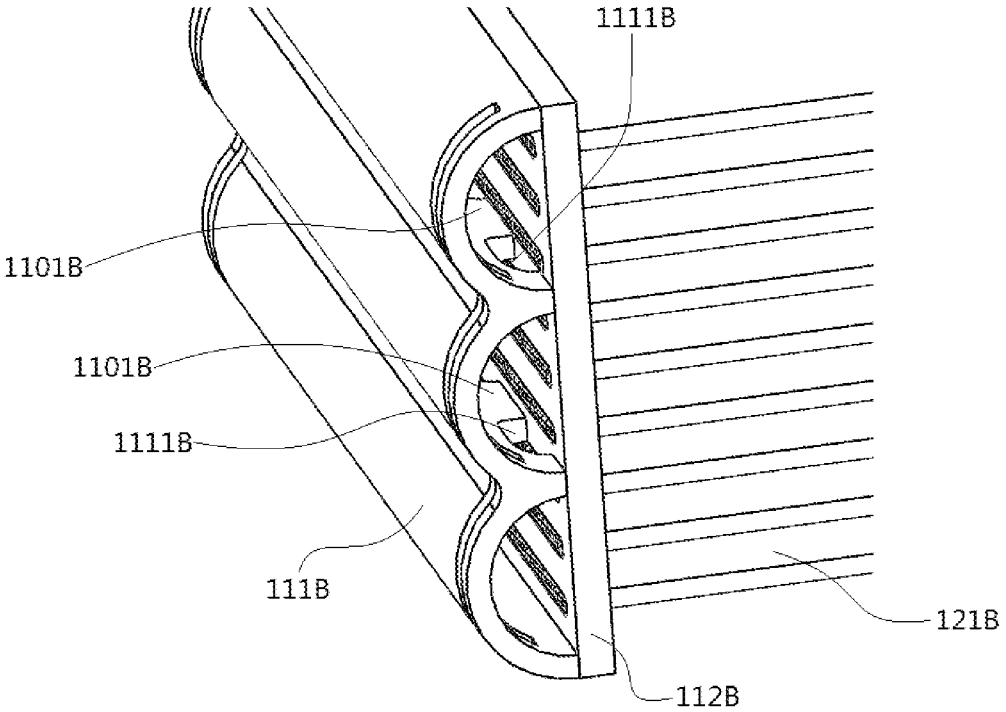
FIG. 8 is a schematic view of the internal structure of the flat pipe component connected to the flow collecting component in the second embodiment.
Figure 9:
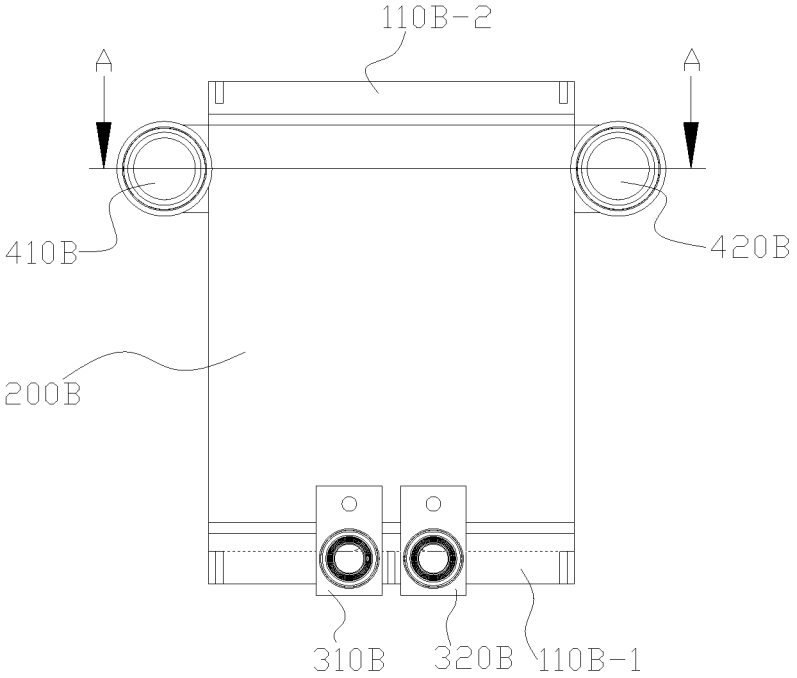
FIG. 9 is a top view of the heat exchange device in FIG. 6.
Figure 10:
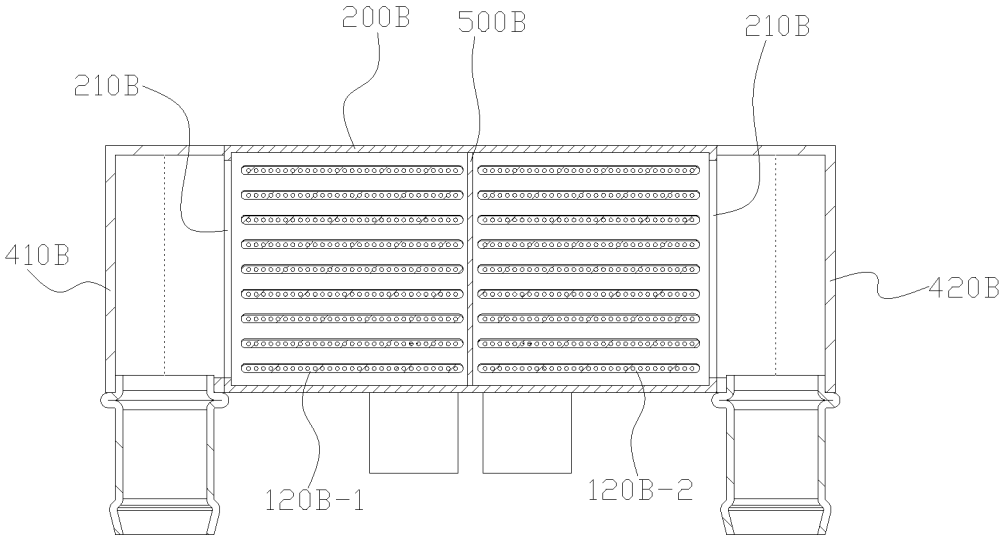
FIG. 10 is a sectional view of FIG. 9 taken along line A-A.
Figure 11:
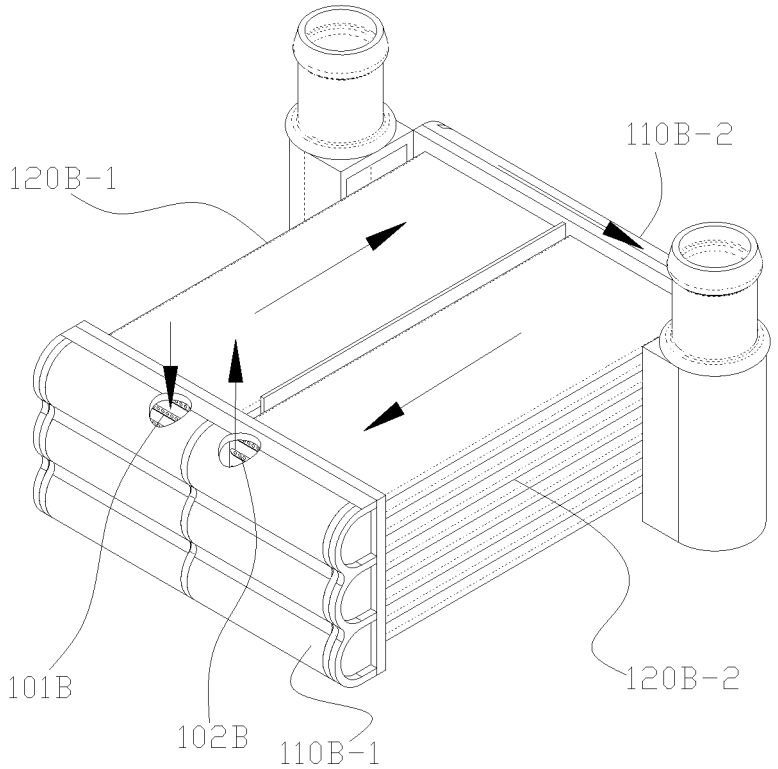
FIG. 11 is a schematic structural view of the core of the heat device shown in FIG. 6, and the arrow in the figure indicates the flow direction of the refrigerant.
Figure 11A:
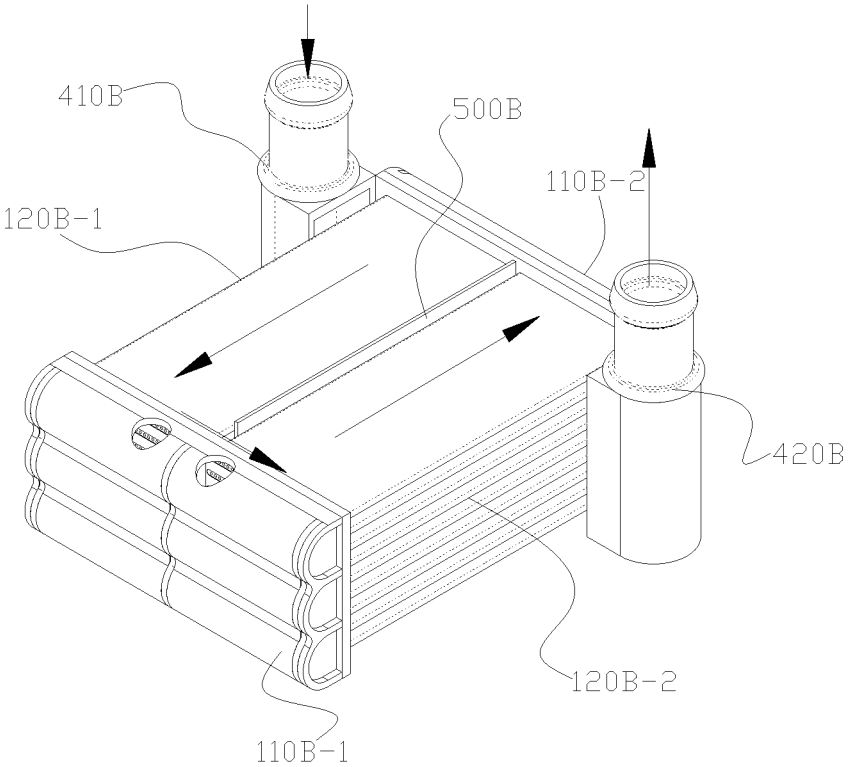
FIG. 11A is a schematic structural view of the core of the heat device shown in FIG. 6, and the arrow in the figure indicates the flow direction of the coolant.

Referring to FIGS. 6 to 11A, FIG. 6 is a schematic structural view of a second embodiment of the heat exchange device according to the present disclosure; FIG. 7 is an exploded view of the heat exchange device shown in FIG. 6; FIG. 8 is a schematic view of the internal structure of the flat pipe component connected to the flow collecting component in the second embodiment; FIG. 9 is a top view of the heat exchange device in FIG. 6; FIG. 10 is a sectional view of FIG. 9 taken along line A-A; FIG. 11 is a schematic structural view of the core of the heat device shown in FIG. 6, and the arrow in the figure indicates the flow direction of the refrigerant; FIG. 11A is a schematic structural view of the core of the heat device shown in FIG. 6, and the arrow in the figure indicates the flow direction of the coolant.

In this embodiment, the heat exchange device includes a core 100B and a housing 200B.

The core 100B includes two abreast flow collecting components, and a flat pipe component is provided between the two flow collecting components. For the convenience of description and understanding below, the two flow collecting components are respectively referred to as a first flow collecting component 110B-1 and a second flow collecting component 110B-2.

The flat pipe component includes multiple flat pipes 121B, and two ends of each flat pipe 121B are respectively communicated with the first flow collecting component 110B-1 and the second flow collecting component 110B-2.

The housing 200B is sleeved outside the core 100B. Specifically, two end portions of the housing 200B are respectively fixedly connected to the first flow collecting component 110B-1 and the second flow collecting component 110B-2, the flat pipe component is located inside the housing 200B, and a coolant flowing space is formed between the housing 200B and the core 100B. It is conceivable that the coolant flowing space is actually a space formed between the housing 200B and the flat pipes 121B.

Flow passages communicating inside the flat pipes 121B of the core 100B is a refrigerant flowing space.

The first flow collecting component 110B-1 has a flow collecting cavity, the first flow collecting component 110B-1 includes a first flow collecting portion and a second flow collecting portion, and a separator 113B is provided between the first flow collecting portion and the second flow collecting portion, so that the flow collecting cavity of the first flow collecting portion and the flow collecting cavity of the second flow collecting portion are not communicated with each other; a part of the flat pipes 121B of the flat pipe component are configured to communicate the flow collecting cavity of the first flow collecting portion with the flow collecting cavity of the second flow collecting component 110B-2, and the other part of the flat pipes 121B are configured to communicate the flow collecting cavity of the second flow collecting portion with the flow collecting cavity of the second flow collecting component 110B-2. In other words, the flow collecting cavity of the first flow collecting portion is communicated with the flow collecting cavity of the second flow collecting portion through a part of the flat pipes 121B, the flow collecting cavity of the second flow collecting component 110B-2, and the other part of the flat pipes 121B.

The second flow collecting component 110B-2 has a flow collecting cavity, and the flow collecting cavity of the second flow collecting component 110B-2 has two or more abreast flow collecting passages 1101B communicated with each other.

As above, in the heat exchange device, the flow collecting cavity of the second flow collecting component 110B-2 is designed in a form of two or more abreast flow collecting passages 1101B communicated with each other, and the first flow collecting component 110B-1 is designed in a form of two abreast flow collecting portions not communicated with each other, so that wall portions forming the flow collecting passages 1101B are configured to bear pressure, and, for a collecting component with the same size, can improve the pressure-bearing capacity. Besides, the first flow collecting portion is communicated with the second flow collecting portion through the flat pipes 121B corresponding to the first flow collecting portion, the second flow collecting component, and the flat pipes 121B corresponding to the second flow collecting portion, which can increase the flow path of the refrigerant such as $CO_2$, thereby improving the heat exchange performance.

The structures of the main parts of the first flow collecting component 110B-1 and the second flow collecting component 110B-2 are basically the same. For the conciseness of description, the following gives unified description for the same structures of the two, and gives separate description for the differences between the two.

In a specific solution, the flow collecting component includes a main body component, a first end plate 114B-1 and a second end plate 114B-2, the flow collecting cavity of the flow collecting component is located in the main body component, and the first end plate 114B-1 and the second end plate 114B-2 block two ends of the flow collecting cavity of the flow collecting component.

For ease of description, referring to FIG. 7, the X-axis direction in the figure is defined as the length direction of the flow collecting component, and the Z-axis direction in the figure is defined the width direction of the flow collecting component.

Specifically, the main body component includes a first wall portion 111B and a second wall portion 112B. The first wall portion 111B has a recessed cavity structure, and the second wall portion 112B blocks an opening of the cavity of the first wall portion 111B, so that the first wall portion 111B and the second wall portion 112B form the main body component of the flow collecting component. In the length direction of the flow collecting component, two ends of the main body component are open, and the first end plate 114B-1 and the second end plate 114B-2 are configured to block the two open ends of the main body component.

In this solution, the first wall portion 111B is relatively away from the flat pipes 121B, and the second wall portion 112B is relatively close to the flat pipes 121B.

In this embodiment, for the first flow collecting component 110B-1, the first wall portion 111B of the first flow collecting component 110B-1 is provided with a separation groove opening outward, and the separator 113B is inserted into the separation groove and the corresponding connection portion is sealed; the separator 113B divides the first flow collecting component 110B-1 into the first flow collecting portion and the second flow collecting portion. Apparently, the inner end of the separator 113B abuts against the second wall portion 112B, so that the flow collecting cavity of the first flow collecting portion and the flow collecting cavity of the second flow collecting portion are not communicated with each other. It is conceivable that, in actual arrangement, the separator 113B may have an integral structure with the main body component of the first flow collecting component 110B-1.

In this embodiment, for the second flow collecting component 110B-2, the first wall portion 111B is provided with two or more through grooves arranged in parallel with openings toward the second wall portion 112B, the through grooves extend along the length direction of the second flow collecting component 110B-2 and communicate with each other, and the through grooves form the flow collecting passages 1101B of the second flow collecting component 110B-2.

In the illustrated solution, the axis of each flow collecting passage 1101B of the second flow collecting component 110B-2 is in parallel with the length direction of the second flow collecting component 110B-2, that is, the flow collecting passages 1101B of the second flow collecting component 110B-2 are arranged along the width direction of the second flow collecting component 110B-2. It is conceivable, in actual arrangement, the axis of each flow collecting passage 1101B of the second flow collecting component 110B-2 may not be parallel to the length direction of the second flow collecting component 110B-2.

In a further solution, the flow collecting cavity of the first flow collecting portion of the first flow collecting component 110B-1 has two or more abreast flow collecting passages 1101B communicated with each other, and the flow collecting cavity of the second flow collecting portion of the first flow collecting component 110B-1 has two or more abreast flow collecting passages 1101B communicated with each other.

Specifically, the formation method of each flow collecting passage 1101B of the first flow collecting portion and the second flow collecting portion is similar to that of the second flow collecting component 110B-2, that is, the first wall portion 111B of the first flow collecting component 110B-1 is also provided with two or more abreast through grooves opening toward the second wall portion 112B and communicated with each other, and an extension direction of each through groove is the length direction of the first flow collecting component 110B-1. In this way, the arrangement of the separator 113B divides each through groove into two parts, respectively forming the flow collecting passages 1101B of the first flow collecting portion and the flow collecting passages 1101B of the second flow collecting portion.

Apparent, in actual arrangement, the axis of each flow collecting passage 1101B of the first flow collecting component 110B-1 may not be parallel to the length direction of the first flow collecting component 110B-1.

The second wall portion 112B of the flow collecting component has multiple insertion holes 1121B adapted to the flat pipes 121B. Specifically, two ends of each flat pipe 121B are respectively inserted into the two second wall portions 112B of the two flow collecting components. In this way, the collecting cavities of the two flow collecting components are communicated through the flat pipes 121B. Specifically, in a state where the flat pipes 121B is inserted into the second wall portion 112B, the flow collecting passages 1101B corresponding to the flow passages communicate with each other. Referring to FIG. 7, the first wall portion 111B has multiple through grooves. It is conceivable that, the first wall portion 111B includes a groove bottom wall portion forming each through groove and a groove side wall portion forming each through groove, and two adjacent through grooves share one groove side wall portion.

In a specific solution, in order to ensure the communication between the flow collecting passages 1101B, multiple notches 1111B may be provided in the groove side wall portion between the two adjacent through grooves, as shown in FIGS. 7 and 8. Apparently, in practical arrangement, a through hole structure may be provided on the corresponding groove side wall portion, to communicate two adjacent through grooves. It can be understood that, the number and arrangement of the notches 1111B or the through holes should enable the flow collecting passages 1101B corresponding to the flow passages to communicate with each other.

In a specific solution, the multiple flat pipes 121B corresponding to the first flow collecting portion of the first flow collecting component 110B-1 form at least one flat pipe group, and the multiple flat pipes 121B corresponding to the second flow collecting portion of the first flow collecting component 110B-1 also form at least one flat pipe group. The multiple flat pipes 121B of each flat pipe group are stacked along the width direction of the flow collecting component, and each flat pipe group is arranged along the length direction of the flow collecting component.

As shown in the figure, in the illustrated solution, along the X-axis direction, the multiple flat pipes 121B of the flat pipe component are only divided into two flat pipe groups, namely a first flat pipe group 120B-1 and a second flat pipe group 120B-2. The flat pipes 121B of the first flat pipe group 120B-1 are configured to communicate the flow collecting cavity of the first flow collecting portion of the first flow collecting component 110B-1 with the flow collecting cavity of the second flow collecting component 110B-2, and the flat pipes 121B of the second flat pipe group 120B-2 are configured to communicate the flow collecting cavity of the second flow collecting portion of the first flow collecting component 110B-1 with the flow collecting cavity of the second flow collecting component 110B-2. In other words, the flow collecting cavity of the first flow collecting portion is communicated with the flow collecting cavity of the second flow collecting portion through the first flat pipe group 120B-1, the flow collecting cavity of the second flow collecting component 110B-2, and the second flat pipe group 120B-2.

Correspondingly, the second wall portion 112B of the flow collecting component is provided with two insertion hole groups, and the two insertion hole groups correspond to the first flat pipe group 120B-1 and the second flat pipe group 120B-2 respectively. Multiple insertion holes 1121B of each insertion hole group are arranged along the Z-axis direction, and the number of insertion holes 1121B of each insertion hole group correspond to the number of the flat pipes 121B of the corresponding flat pipe group.

Specifically, on the basis that the first flow collecting component 110B-1 is divided into the first flow collecting portion and the second flow collecting portion, it is conceivable that, the separator 113B should be located between the first flat pipe group 120B-1 and the second flat pipe group 120B-2, the first flow collecting component 110B-1 is provided with a first fluid port 101B and a second fluid port 102B, where the first fluid port 101B is communicated with the flow collecting cavity of the first flow collecting portion, and the second fluid port 102B is communicated with the flow collecting cavity of the second flow collecting portion. Specifically, the first fluid port 101B and the second fluid port 102B are both formed on the first wall portion 111B of the first flow collecting component 110B-1.

Referring to FIGS. 7, 9 and 11, as shown in the figures, the fluid port on the left side of the first wall portion 111B of the first flow collecting component 110B-1 is the first fluid port 101B. Correspondingly, the left portion of the first flow collecting component 110B-1 is the first flow collecting portion. The fluid port on the right side of the first wall portion 111B of the first flow collecting component 110B-1 is the second fluid port 102B. Correspondingly, the right portion of the first flow collecting component 110B-1 is the second flow collecting portion.

In the figures, by way of example that the first fluid port 101B on the left side is the refrigerant inlet and the second fluid port 102B on the right side is the refrigerant outlet to illustrate the flow passage of the refrigerant, arrows in FIG. 6 indicate the flow direction of the refrigerant.

After the refrigerant flows from the first fluid port 101B into the flow collecting cavity of the first flow collecting portion of the first flow collecting component 110B-1, due to the separation by the separator 113B in the first flow collecting component 110B-1, the refrigerant can only flow into the flow collecting cavity of the second flow collecting component 110B-2 through the flat pipes 121B of the first flat pipe group 120B-1. Since there is no separator in the flow collecting cavity of the second flow collecting component 110B-2, the refrigerant flows into the flow collecting cavity of the second flow collecting component 110B-2, and then flows into the flow collecting cavity of the second flow collecting portion of the first flow collecting component 110B-1 though the flat pipes 121B of the second flat pipe group 120B-2, and finally flows out from the second fluid port 102B.

In the specific arrangement, the separator 113B may be arranged in the middle of the first flow collecting component 110B-1, to symmetrically separate the flow collecting cavity of the first flow collecting component 110B-1. Apparently, the separator 113B may not be arranged in the middle of the first flow collecting component 110B-1 according to requirements, and the lengths of the separated first flow collecting portion and second flow collecting portion may be different.

In the specific arrangement, the first flow collecting portion and the second flow collecting portion may both be provided with two or more flat pipe groups, the flow collecting portions may have different number of corresponding flat pipe groups, and the flat pipe groups may have the same number or different number of flat pipes 121B, which may be specifically determined according to requirements and actual conditions.

In a specific solution, the number of the flow collecting passages 1101B of the first flow collecting component 110B-1 is the same as the number of the flow collecting passages of the second flow collecting component 110B-2. The number of the flow collecting passages 1101B of each flow collecting component may be designed according to needs, for example, the number is preferably 2 to 8. Apparently, in practice, the number of the flowing passages may be determined in combination with actual requirements such as specific size of the flow collecting component and the specific type of the refrigerant.

In a further solution, the groove bottom wall section corresponding to the through groove of the first wall portion 111B of the flow collecting component has a curved structure protruding outward, and a smooth transition is provided between the groove bottom wall sections of two adjacent through grooves. With this design, an outer side wall surface of the flow collecting passage 1101B has the curved structure protruding outward. This structure is able to further improve the pressure-bearing capacity of each flow collecting passage 1101B, thereby improving the pressure-bearing capacity of the flow collecting component under the same size, which enables the core 100B to be applicable for the refrigerant with a high requirement on the pressure resistance, such as $CO_2$.

Specifically, each groove bottom wall section of the first wall portion 111B has an arc-shaped structure, preferably a semicircular arc which has a symmetrical structure, is easy to process and is more conducive to improving the pressure-bearing capacity.

In a specific solution, an equivalent diameter of the cross section of each flow collecting passage 1101B of the flow collecting component may range from 5 mm to 25 mm. Apparently, in practice, the equivalent diameter may have other values according to requirements.

In a specific solution, sealing grooves 115B with outward openings are respectively provided at positions close to two ends of the first wall portion 111B, the shapes of the first end plate 114B-1 and the second end plate 114B-2 match the sealing grooves 115B, and the first end plate 114B-1 and the second end plate 114B-2 are inserted into the sealing grooves 115B and the corresponding connection portions are sealed.

As above, the first end plate 114B-1 and the second end plate 114B-2 block the end openings of the flow collecting component by inserting, which can improve the reliability of the connection between the first end plate 114B-1, the second end plate 114B-2, the first wall portion 111B, and the second wall portion 112B. Compared with the method of directly blocking the end surface openings, this method is able to bear greater pressure and further improve the pressure-bearing capacity of the flow collecting component.

Referring to FIG. 7, it can be seen that in the illustrated solution, the assembling method of the separator 113B with the first wall portion 111B of the first flow collecting component 110B-1 is similar to the assembling method of the first end plate 114B-1 and the second end plate 114B-2 with the first wall portion 111B of the first flow collecting component 110B-1.

Taking the illustrated solution as an example, specifically, the first fluid port 101B and the second fluid port 102B are both formed on the first wall portion 111B of the first flow collecting component 110B-1. Apparently, the first fluid port 101B and the second fluid port 102B are separately provided on two sides of the separator 113B inside the first flow collecting component 110B-1.

In the illustrated solution, the first fluid port 101B and the second fluid port 102B are both located on the upper side of the first wall portion 111B. It is conceivable that, in practical arrangement, the two fluid ports may be located on the upper and lower sides of the first wall portion 111B.

In this embodiment, the heat exchange device further includes fluid port seat components to facilitate the installation of pipe fittings communicating with the fluid ports.

The heat exchange device further includes a first port seat 310B and a second port seat 320B, which respectively cooperate with the first fluid port 101B and the second fluid port 102B. In the illustrated solution, the first port seat 310B and the second port seat 320B both have an integral structure. The first port seat 310B has a first port, the first port seat 310B is fixed to the first wall portion 111B of the first flow collecting component 110B-1, and the first port is communicated with the flow collecting cavity of the first flow collecting portion through the first fluid port 101B; the second port seat 320B has a second port, the second port seat 320B is fixed to the first wall portion 111B of the first flow collecting component 110B-1, and the second port is communicated with the flow collecting cavity of the second flow collecting portion through the second fluid port 102B.

In this embodiment, the structure of each flat pipe 121B of the flat pipe component is the same as that of the foregoing first embodiment, and will not be repeated here.

Combined with the structure of the above flow collecting component, the structure design of the core 100B is applicable for refrigerants such as $CO_2$ and the like without increasing the size, which not only meets the environmental protection requirements, but also meets the development requirements of lightweight of automobiles.

Combined with the structure of the above flow collecting component, the structure design of the core 100B is applicable for refrigerants such as $CO_2$ and the like without increasing the size, which not only meets the environmental protection requirements, but also meets the development requirements of lightweight of automobiles.

The specific structure of the core 100B of the heat exchange device is described above in detail, and the detailed structure of the refrigerant flowing space is described. The following describes the coolant flowing space.

As described above, the coolant flowing space is formed between the housing 200B and the core 100B.

Referring to FIGS. 6 and 10, in this embodiment, the housing 200B has an integral structure, and is specifically formed by connecting four housing walls sequentially. For ease of description, two housing walls arranged along the X-axis direction are referred to as side walls of the housing 200B, and two housing walls arranged along the Z-axis direction are referred to as a top wall and a bottom wall of the housing 200B respectively. The top wall is the upper housing wall in the figure, and the bottom wall is the lower housing wall in the figure.

It is conceivable that, since the coolant flowing space is formed between the housing 200B and the core 100B, the connection between the housing 200B and the core 100B is sealed. Specifically, the flat pipe component of the core 100B is located inside the housing 200B, and two end surfaces of the housing 200B are connected to the second wall portions 112B of the two flow collecting components of the core 100B.

In this embodiment, one or more baffle plate 500B is provided in the housing 200B, and one end of the baffle plate 500B is kept at a predetermined distance from one of the first flow collecting component 110B-1 and the second flow collecting component 110B-2. Another end of the baffle plate 500B is fixed to the other one of the first flow collecting component 110B-1 and the second flow collecting component 110B-2. Two side portions of the baffle plate 500B are fixed to an inner wall of the housing 200B, to divide the coolant flowing space into two or more abreast coolant flow passages communicated with each other, and the two or more coolant flow passages are such configured that two adjacent coolant flow passages are separated at one end and are communicated at another end.

The coolant flow passages are parallel to the circulation passages between the first flow collecting portion and the second flow collecting component 110B-2 of the core 100B, and are parallel to the circulation passages between the second flow collecting portion and the second flow collecting component 110B-2, to facilitate the heat exchange between the coolant flowing in the coolant flow passages and the refrigerant flowing in the circulation passages.

The housing 200B has two coolant ports 210B, which are respectively communicated with the two coolant flow passages located outside.

It is conceivable that, with the above arrangement, the coolant flowing in from one coolant port 210B is able to flow through the coolant flow passages in sequence and then flow out from the other coolant port 210B, that is, the flow path of the coolant in the coolant flowing space is similar to a serpentine.

The heat exchange device further includes a first coolant pipe-connecting component 410B and a second coolant pipe-connecting component 420B, which respectively cooperate with the two coolant ports 210B to facilitate connection with the coolant pipes.

Specifically, the first coolant pipe-connecting component 410B includes a first pipe-connecting seat body 411B and a first connecting pipe 412B. The first pipe-connecting seat body 411B has a communication port communicating with an inner cavity of the first pipe-connecting seat body. The first pipe-connecting seat body 411B is connected to the side wall of the housing 200B, and after the connection, the communication port is communicated with the coolant port 210B. The first connecting pipe 412B is fixedly inserted in the first pipe-connecting seat body 411B, and the first connecting pipe 412B is communicated with the inner cavity of the first pipe-connecting seat body 411B, so that the first connecting pipe is communicated with the coolant port 210B through the communication port.

The second coolant pipe-connecting component 420B has a similar structure to the first coolant pipe-connecting component 410B, and includes a second pipe-connecting seat body 421B and a second connecting pipe 422B. The specific structure and connection method are similar to those of the first coolant pipe-connecting component 410B and will not be repeated here.

For ease of understanding, take the solution shown in the figure as an example, only one baffle plate 500B is provided in the housing 200B, and the baffle plate 500B divides the coolant flowing space into two coolant flow passages.

Referring to FIG. 11A, FIG. 11A is a schematic structural view of the core of the heat device, which further shows the structure of the coolant pipe-connecting component, so as to facilitate the description of the location and the flow path of the coolant port.

In this embodiment, the flat pipes 121B of each flat pipe group are arranged along the Z-axis direction. Therefore, the baffle plate 500B arranged in the housing 200B can only be located between two adjacent flat pipe groups, as shown in the illustrated solution. On the basis that the first flow collecting component 110B-1 of the core 100B is divided into the first flow collecting portion and the second flow collecting portion, it is conceivable that the two flow collecting portions correspond to the two coolant flow passages in positions.

In this embodiment, since the flat pipes 121B are arranged along the Z-axis direction, in order to facilitate the flow of the coolant in the flat pipes 121B, the two coolant ports 210B are respectively formed on the two side walls of the housing 200B, that is, after the flowing into the housing 200B from one coolant port 210B, the coolant can directly flow between the flat pipes 121B, which facilitates the flow of the coolant in the coolant flow passages.

On the basis of arranging two coolant flow passages, it is conceivable the two coolant ports 210B are located at a same end of the housing 200B.

In the illustrated solution, the two coolant ports 210B are provided at one end of the housing 200B close to the second flow collecting component 110B-2. On this basis, one end of the baffle plate 500B located inside the housing 200B abuts against the second flow collecting component 110B-2, so that the two coolant flow passages are separated on the side where the second flow collecting component 110B-2 is located, to prevent the coolant flowing in from one coolant port 210B directly flows out from the other coolant port 210B without passing through the coolant flow passages. Correspondingly, another end of the baffle plate 500B is kept at a predetermined distance from the first flow collecting component 110B-1, so that the two coolant flow passages are communicated on the side where the first flow collecting component 110B-1 is located.

It is conceivable that the upper and lower ends of the baffle plate 500B abut against the top wall and the bottom wall of the housing 200B respectively, so that the two coolant flow passages are communicated only on the side where the first flow collecting component 110B-1 is located.

In a specific solution, positioning grooves adapted to the baffle plate 500B may be provided at the corresponding positions of the bottom wall and the top wall of the housing 200B, to facilitate the installation of the baffle plate 500B to the housing 200B.

Specifically, the bottom wall or the top wall of the housing 200B may be fixedly connected with two parallel protruding strips at appropriate positions, and the positioning groove adapted to the baffle plate 500B is formed between the two protruding strips.

In practical arrangement, the baffle plate 500B may abut against the first flow collecting component 110B-1, and be provided with a notch structure or a through hole structure at an end close to the first flow collecting component 110B-1. The two coolant flow passages are communicated on the side where the first flow collecting component 110B-1 is located through the notch structure or the through hole structure.

In the orientation shown in FIG. 11A, assuming that the first coolant pipe-connecting component 410B is a coolant inlet pipe and the second coolant pipe-connecting component 420B is a coolant outlet pipe, the flow path of the coolant in the heat exchange device is that:

the coolant in the first coolant pipe-connecting component 410B flows into the housing 200B through the corresponding coolant port 210B, and then flows directly between the flat pipes 121B of the first flat pipe group 120B-1, and due to the separation effect of the baffle plate 500B, the coolant can only flow from the second flow collecting component 110B-2 to the first flow collecting component 110B-1 along the coolant flow passages on the left side of the baffle plate 500B. When the coolant flows to the position of the first flow collecting component 110B-1, due to the predetermined distance between the baffle plate 500B and the first flow collecting component 110B-1, the coolant is able to flow from the left side to the right side of the baffle plate 500B, and flows from the first flow collecting component 110B-1 to the second flow collecting component 110B-2 along the coolant flow passages on the right side of the baffle plate 500B. When the coolant flows to the position of the second flow collecting component 110B-2, due to the separation effect of the baffle plate 500B, the coolant is able to flow out of the second coolant pipe-connecting component 420B through the coolant port 210B at the corresponding position.

Taking the examples shown in FIGS. 11 and 11A, in the corresponding refrigerant flow passage and coolant flow passage, the flow direction of the refrigerant is opposite to the flow direction of the coolant. It is conceivable that, in practical arrangement, the flow direction of the refrigerant may be the same as that of the coolant by changing the inlet and the outlet.

It should be noted herein that, in the above embodiment, two coolant flow passage are provided, but in practical arrangement, three or other numbers of coolant flow passages may be provided.

In a specific solution, the heat exchange device further includes multiple fins arranged in the housing 200B, and the fins are located between two adjacent flat pipes 121B, or between the flat pipe 121B and the housing 200B, so as to enhance heat exchange.

Specifically, the fin may have a continuous corrugated structure or a square wave structure to increase the heat exchange area.

Specifically, the extension direction of the fins may be consistent with the length direction of the flat pipes 121B, or perpendicular to the length direction of the flat pipes 121B, or in other forms. Two adjacent fins may be staggered. Different arrangement methods of the fins affect the effect of the heat exchange, and the arrangement method of the fins may be determined according to specific requirements in practice.

Specifically, structures such as bumps or ribs may be provided on the surface of the fin to enhance the effect of the heat exchange.

Embodiment 3

Figure 12:
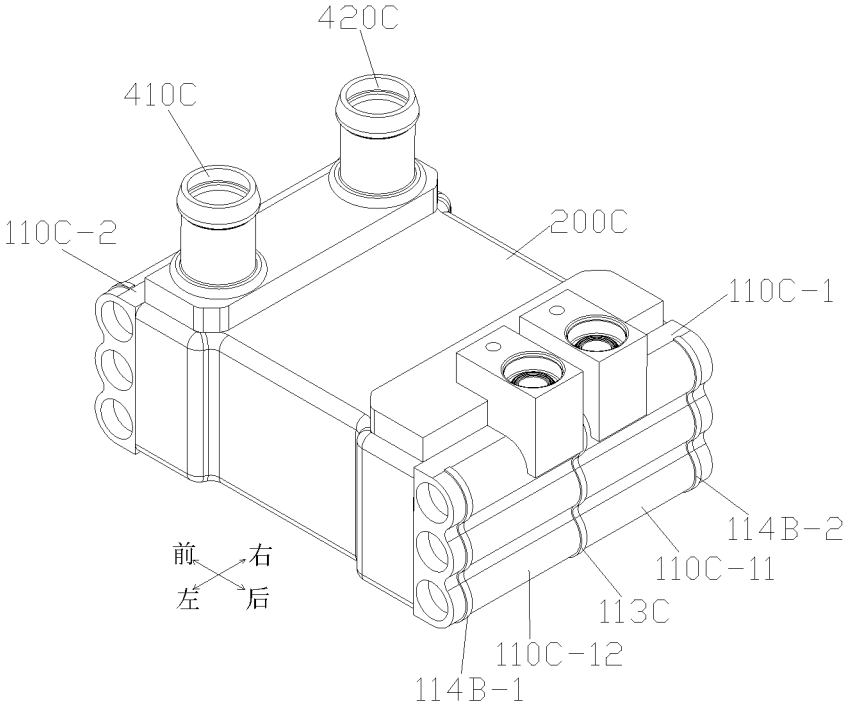
FIG. 12 is a schematic structural view of a third embodiment of the heat exchange device according to the present disclosure.
Figure 13:
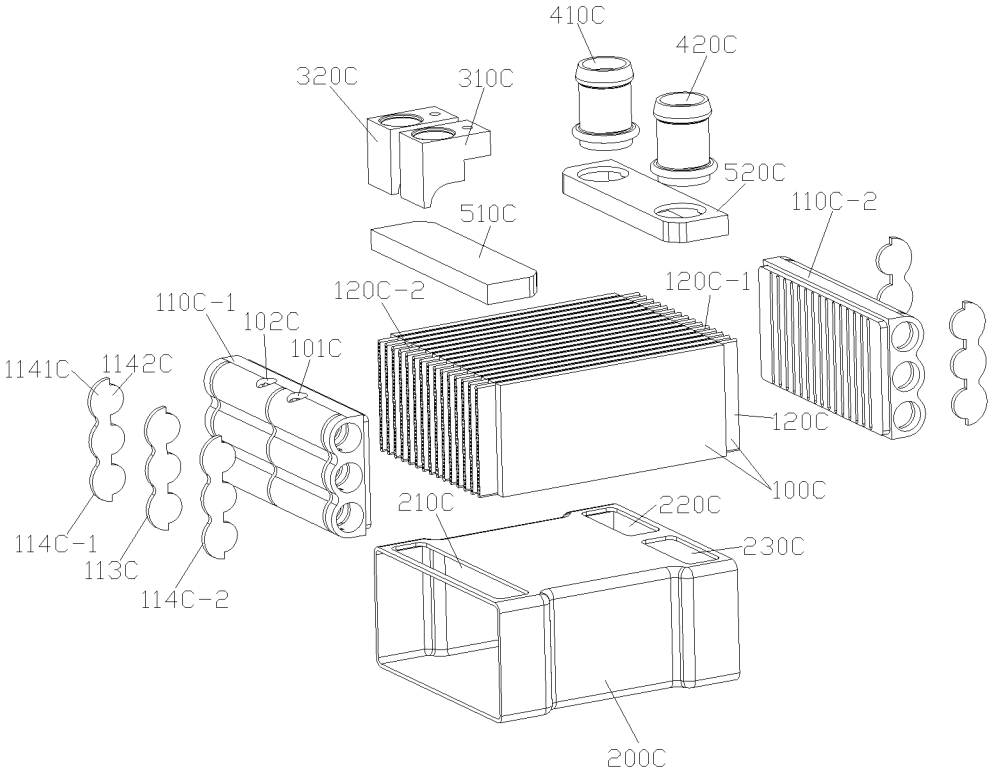
FIG. 13 is an exploded structural view of the heat exchange device shown in FIG. 12.
Figure 14:
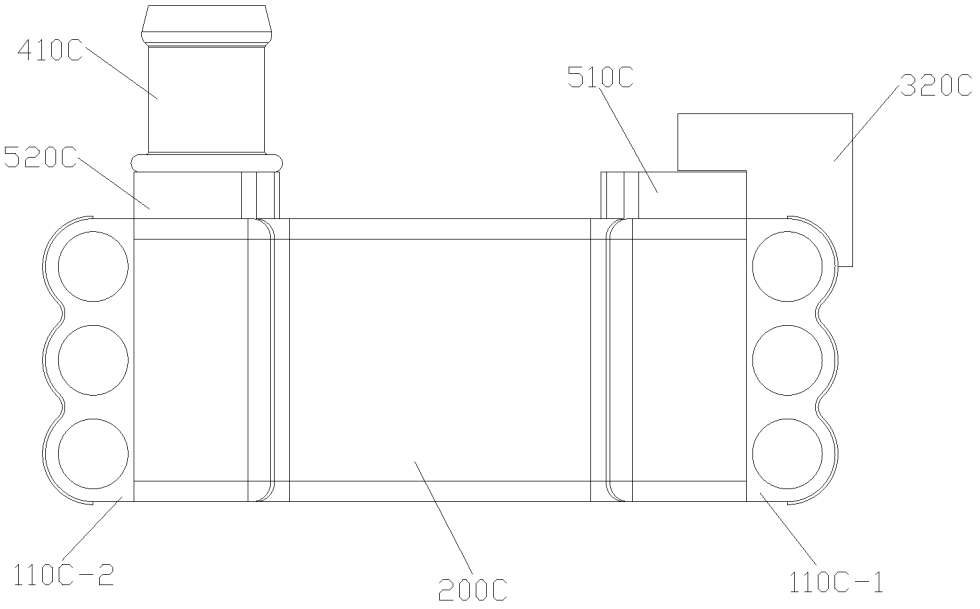
FIG. 14 is a side view of the heat exchange device shown in FIG. 12.
Figure 15:
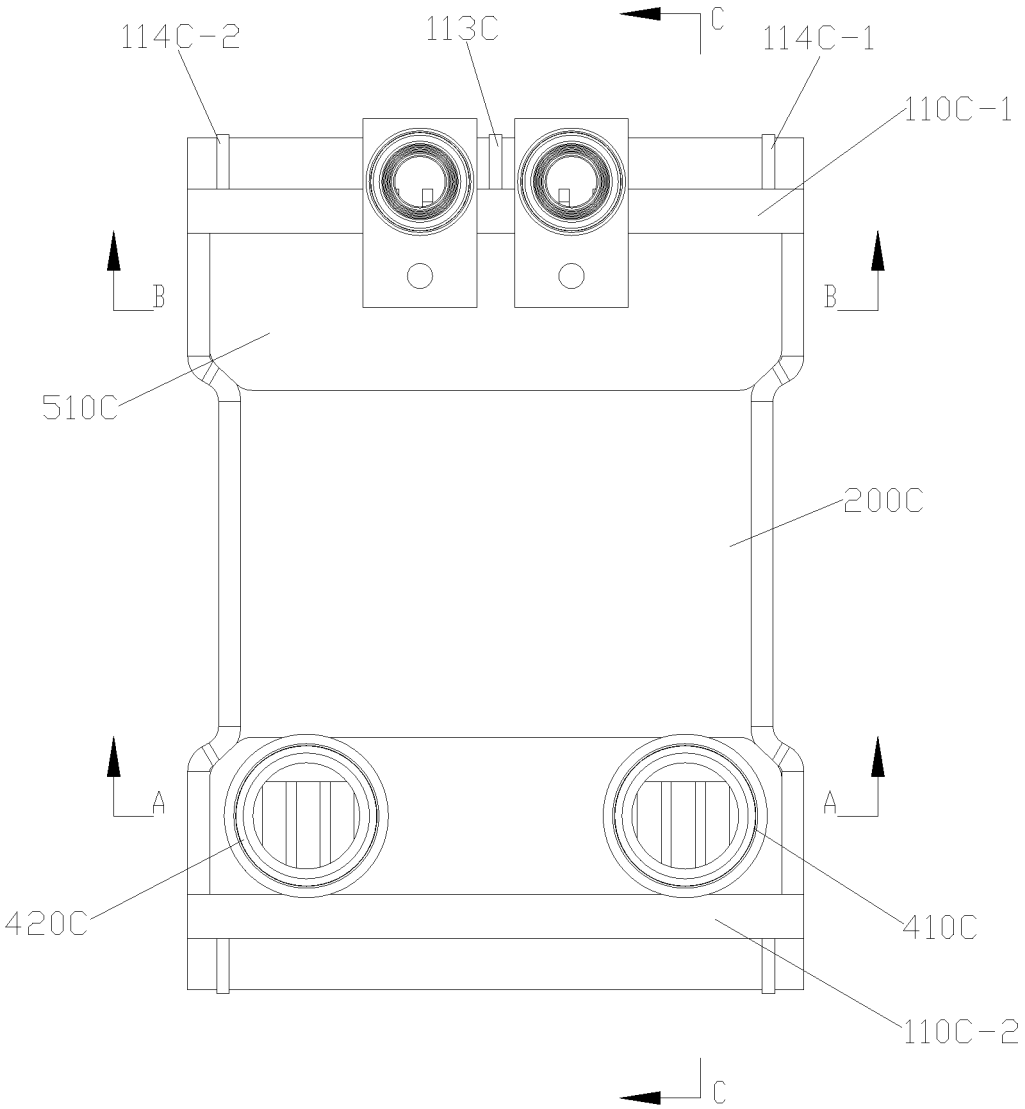
FIG. 15 is a top view of the heat exchange device in FIG. 12.

Referring to FIGS. 12, 13 and 14, FIG. 12 is a schematic structural view of a third embodiment of the heat exchange device according to the present disclosure; FIG. 13 is an exploded structural view of the heat exchange device shown in FIG. 12; FIG. 14 is a side view of the heat exchange device shown in FIG. 12.

In this embodiment, the heat exchange device according to the present disclosure is a heat exchange device applicable for $CO_2$ refrigerant. Compared with the conventional $CO_2$ heat exchange device, the heat exchange device has strong pressure-bearing capacity and high heat exchange efficiency. Moreover, the heat exchange device has small size, light weight and low cost.

As shown in the figure, the heat exchange device mainly includes a core 100C and a housing 200C. The core 100C includes a first flow collecting component 110C-1 and a second flow collecting component 110C-2 which are oppositely arranged. A flat pipe component 120C is provided between the first flow collecting component 110C-1 and the second flow collecting component 110C-2.

The flat pipe component 120C includes a first flat pipe group 120C-1 and a second flat pipe group 120C-2. Each of the first flat pipe group 120C-1 and the second flat pipe group 120C-2 includes multiple flat pipes. Two ends of each flat pipe are respectively communicated with the first flow collecting component 110C-1 and the second flow collecting component 110C-2, and two ends of the housing 200C are fixedly connected to the two flow collecting components respectively. The flat pipe component 120C is located in the housing 200C, and a coolant flowing space is formed in the housing 200C.

The second flow collecting component 110C-2 has a flow collecting cavity, and the flow collecting cavity of the second flow collecting component 110C-2 has three abreast flow collecting passages 1101C communicated with each other.

The first flow collecting component 110C-1 has a flow collecting cavity, the first flow collecting component 110C-1 includes a first flow collecting portion 110C-11 and a second flow collecting portion 110C-12, and a separator 113C is provided between the first flow collecting portion 110C-11 and the second flow collecting portion 110C-12. The flat pipes of the first flat pipe group 120C-1 are stacked in the length direction of the flow collecting cavity of the first flow collecting portion 110C-11, and each flat pipe is communicated with the flow collecting cavity of the first flow collecting portion 110C-11. The flat pipes of the second flat pipe group 120C-2 are stacked in the length direction of the flow collecting cavity of the second flow collecting portion 110C-12, and each flat pipe is communicated with the flow collecting cavity of the second flow collecting portion 110C-12. The first flow collecting portion 110C-11 is communicated with the second flow collecting portion 110C-12 through the first flat pipe group 120C-1, the second flow collecting component 110C-2, and the second flat pipe group 120C-2.

Figure 16:
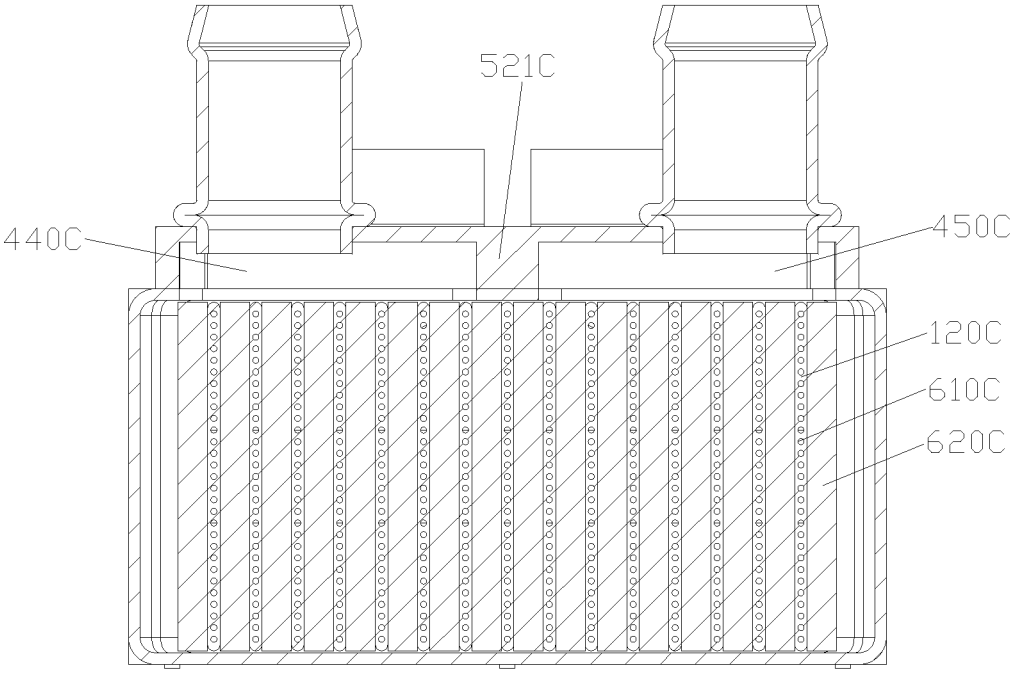
FIG. 16 is a sectional view of FIG. 15 taken along line A-A.
Figure 17:
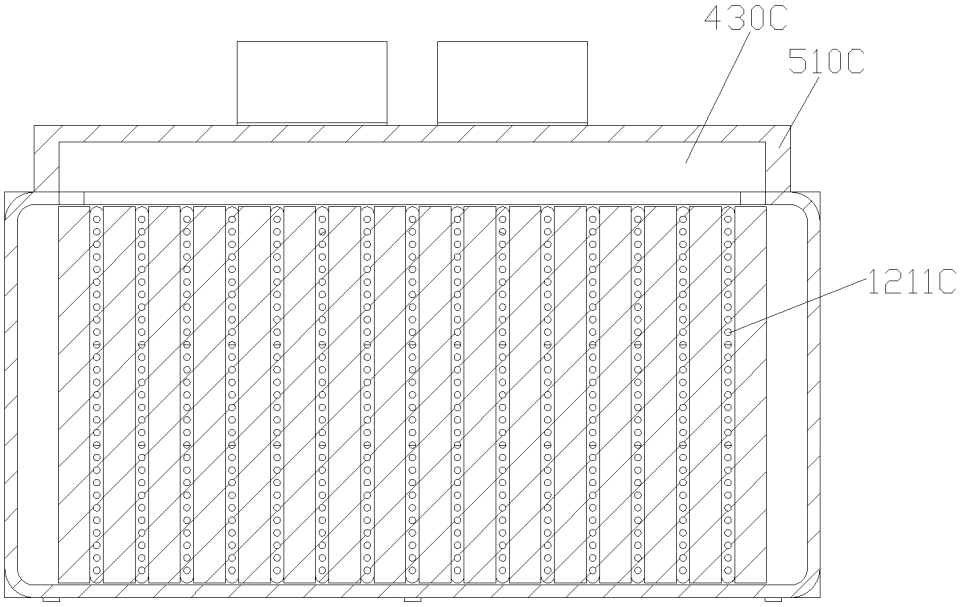
FIG. 17 is a sectional view of FIG. 15 taken along line B-B.
Figure 18:
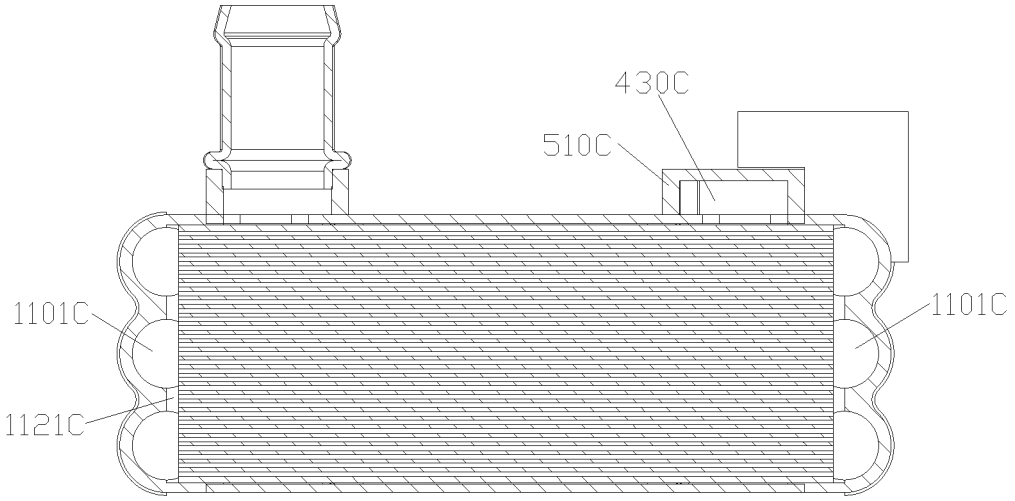
FIG. 18 is a sectional view of FIG. 15 taken along line C-C.
Figure 19:
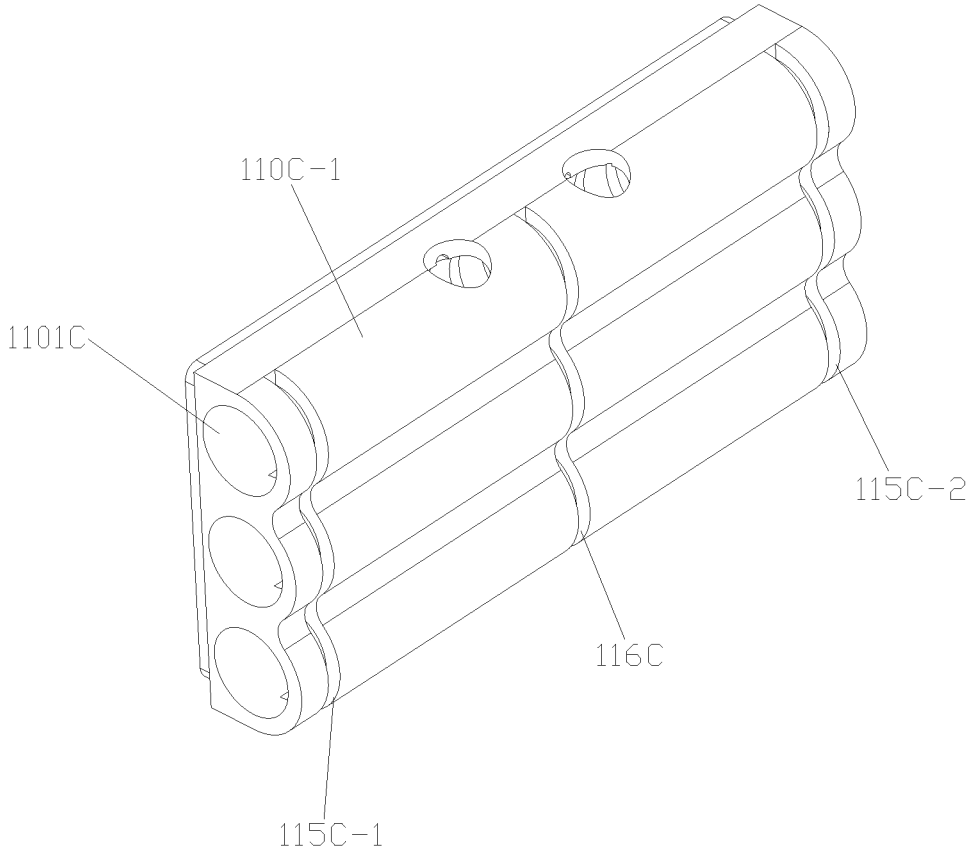
FIG. 19 is a schematic structural view of a first flow collecting component shown in FIG. 12.

Referring to FIGS. 15 to 18, FIG. 15 is a top view of the heat exchange device in FIG. 12; FIG. 16 is a sectional view of FIG. 15 taken along line A-A; FIG. 17 is a sectional view of FIG. 15 taken along line B-B; FIG. 18 is a sectional view of FIG. 15 taken along line C-C.

The flow collecting cavity of the first flow collecting portion 110C-11 has three abreast flow collecting passages 1101C communicated with each other, and the flow collecting cavity of the second flow collecting portion 110C-12 has three abreast flow collecting passages 1101C communicated with each other. Each flow collecting passage 1101C of the first flow collecting portion 110C-11 is communicated with the flow collecting cavity of the second flow collecting component 110C-2 through the first flat pipe group 120C-1, and each flow collecting passage 1101C of the second flow collecting portion 110C-12 is communicated with the flow collecting cavity of the second flow collecting component 110C-2 through the second flat pipe group 120C-2.

The first flow collecting component 110C-1 includes a main body component, a first end plate 114C-1 and a second end plate 114C-2. The flow collecting cavity of first flow collecting component 110C-1 is located in the main body component. The main body component includes a first wall portion and a second wall portion. The first wall portion is provided with a first end sealing groove 115C-1, a flow path separation groove 116C, and a second end sealing groove 115C-2 all of which face away from the second wall portion. The first end plate 114C-1 is inserted into the first end sealing groove 115C-1, the second end plate 114C-2 is inserted into the second end sealing groove 115C-2, and the separator 113C is inserted into the flow path separation groove 116C. The separator 113C divides the first flow collecting component 110C-1 into the first flow collecting portion 110C-11 and the second flow collecting portion 110C-12. The flow collecting passages 1101C of the first flow collecting portion 110C-11 are arranged in the width direction of the first flow collecting component 110C-1, the flow collecting passages 1101C of the second flow collecting portion 110C-12 are arranged in the width direction of the first flow collecting component 110C-1, and the second wall portion has multiple insertion holes 1121C adapted to the flat pipes.

The first end plate 114C-1, the second end plate 114C-2 and the separator 113C are connected by welding to the main body component. The second flow collecting component 110C-2 is also provided with insertion holes 1121C adapted to the flat pipes, the flat pipes are inserted into the insertion holes 1121C of the first flow collecting component 110C-1 at one end and the corresponding connection portions are sealed, and the flat pipes are inserted into the insertion holes 1121C of the second flow collecting component 110C-2 at the other end and the corresponding connection portions are sealed.

Figure 20:
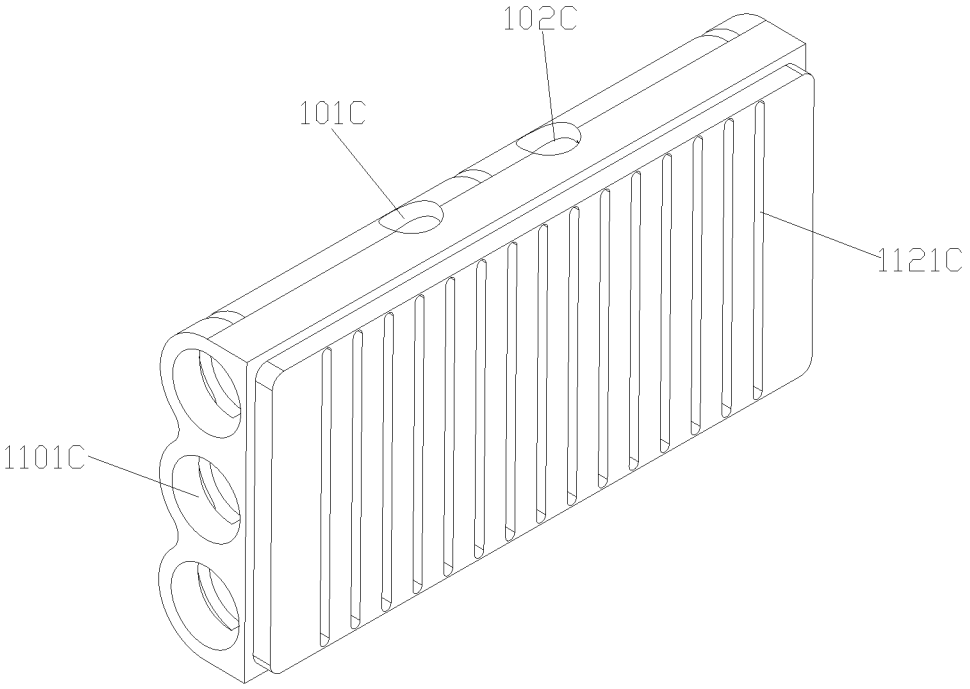
FIG. 20 is a schematic structural view of the first flow collecting component from another perspective.
Figure 21:
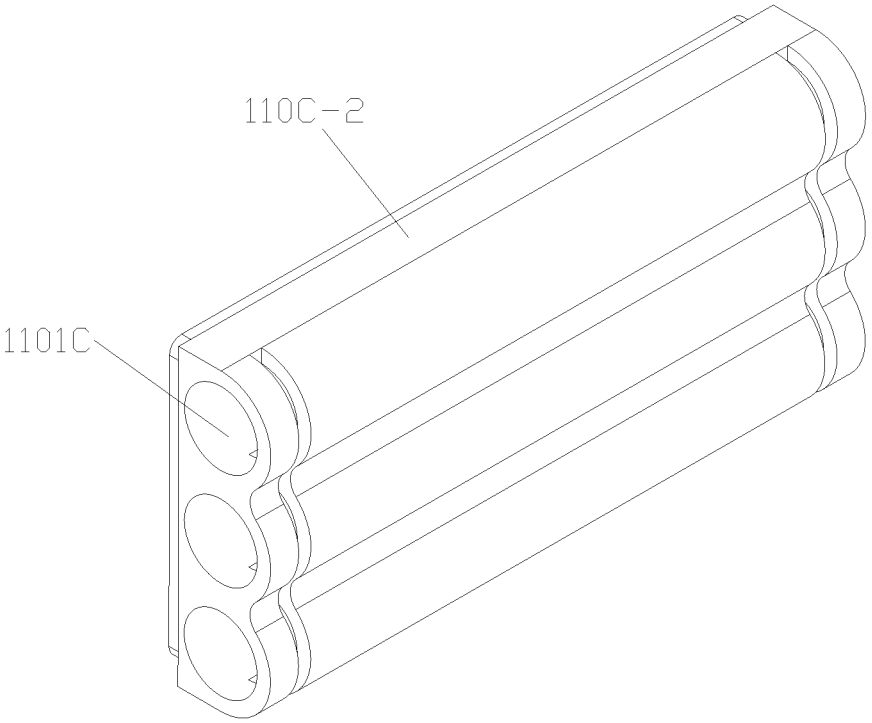
FIG. 21 is a schematic structural view of a second flow collecting component in FIG. 12.
Figure 22:
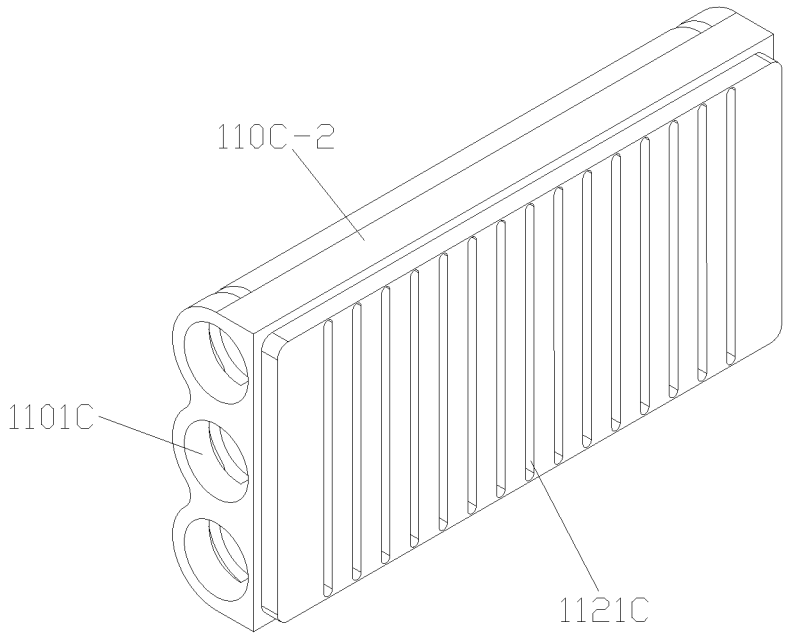
FIG. 22 is a schematic structural view of the second flow collecting component from another perspective.

Referring to FIGS. 19 to 22, FIG. 19 is a schematic structural view of a first flow collecting component shown in FIG. 12; FIG. 20 is a schematic structural view of the first flow collecting component from another perspective; FIG. 21 is a schematic structural view of a second flow collecting component in FIG. 12; FIG. 22 is a schematic structural view of the second flow collecting component from another perspective.

Figure 23:
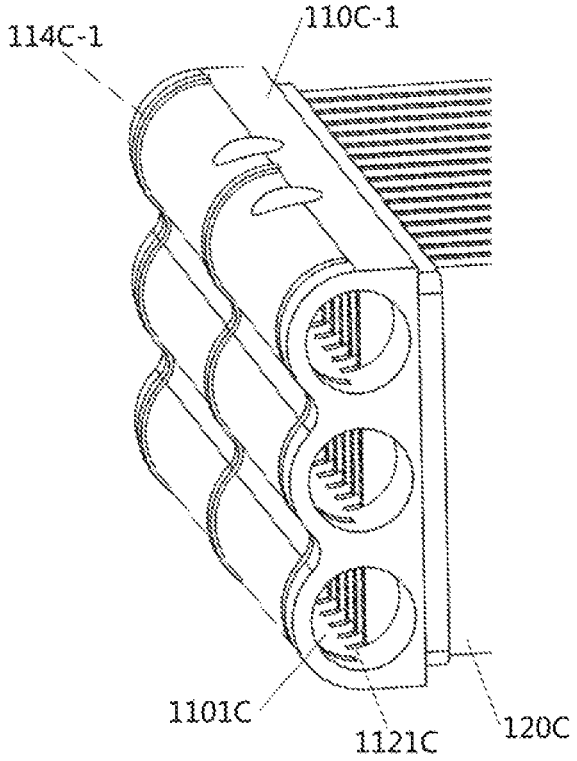
FIG. 23 is a schematic view of the insertion between flat pipes and the first flow collecting component.

The depth of the insertion holes 1121C is greater than the insertion depth of the flat pipes. A flow passage communicating with the upper and lower flow collecting passages 1101C is formed between the end of the flat pipes and the bottom of the insertion holes 1121C (see FIG. 23). The insertion holes 1121C are configured to allow insertion of the flat pipes and form a flow passage.

The flow collecting passages 1101C of a single flow collecting component may be communicated through a separately provided channel. In this case, the end of the flat pipes can be completely inserted into the insertion holes 1121C without leaving a gap with the bottom of the insertion holes 1121C.

The flow collecting passages 1101C of the first flow collecting component 110C-1 and the second flow collecting component 110C-2 are circular, and three arch tops are formed on an outer surface of the first wall portion of each flow collecting portion.

The main body component of the first flow collecting component 110C-1 is provided with a first fluid port 101C and a second fluid port 102C, the first fluid port 101C is communicated with the flow collecting cavity of the first flow collecting portion 110C-11, and the second fluid port 102C is communicated with the flow collecting cavity of the second flow collecting portion 110C-12. The heat exchange device further includes a first port seat 310C and a second port seat 320C. The first port seat 310C is provided with a first port, and the second port seat 320C is provided with a second port. The first port seat 310C and the second port seat 320C are fixed to the main body component. The first port is communicated with the flow collecting cavity of the first flow collecting portion 110C-11 through the first fluid port 101C, and the second port is communicated with the flow collecting cavity of the second flow collecting portion 110C-12 through the second fluid port 102C.

Figure 24:
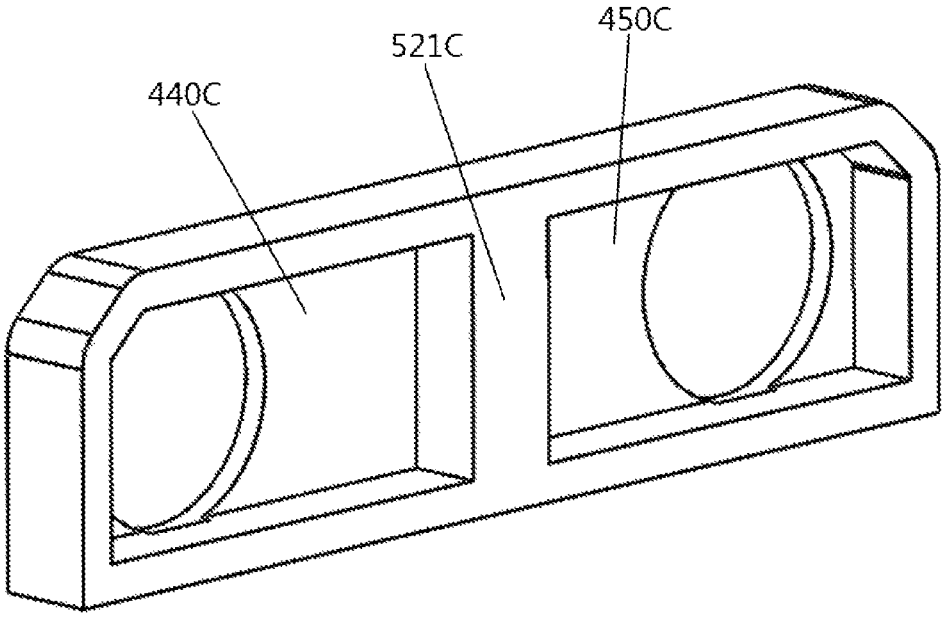
FIG. 24 is a schematic structural view of a separation rib provided between a distribution region and a collecting region of a second adapter block.
Figure 25:
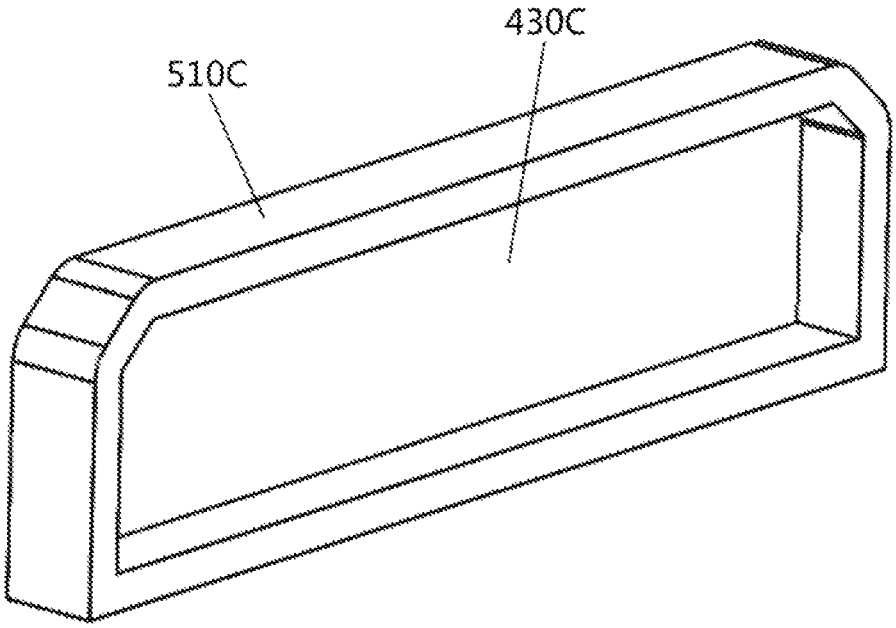
FIG. 25 is a schematic structural view of a first adapter block with a hollow bridge region.

Referring to FIGS. 24 and 25, FIG. 24 is a schematic structural view of a separation rib provided between a distribution region and a collecting region of a second adapter block; and FIG. 25 is a schematic structural view of a first adapter block with a hollow bridge region.

The heat exchange device includes a first adapter block 510C and a second adapter block 520C, the first adapter block 510C includes a hollow bridge region 430C, and the second adapter block 520C includes a hollow distribution region 440C and a hollow collecting region 450C. A separation rib 521C is provided between the distribution region 440C and the collecting region 450C. The housing 200C is provided with a first orifice 210C, a second orifice 220C and a third orifice 230C, the bridge region 430C is communicated with the first orifice 210C, the distribution region 440C is communicated with the second orifice 220C, and the collecting region 450C is communicated with the third orifice 230C. The first adapter block 510C and the second adapter block 520C are fixed to the housing 200C by welding, the first adapter block 510C is close to the first flow collecting component 110C-1, and the second adapter block 520C is close to the second flow collecting component 110C-2.

The projection of the end of each flat pipe close to the first orifice 210C on the side of the first orifice 210C of the housing 200C is located in the first orifice 210C, and the projection of the end of each flat pipe away from the first orifice 210C on the side of the second orifice 220C of the housing 200C is located in the second orifice 220C and the third orifice 230C. The flat pipes are in contact with the inner wall of the side of the housing 200C where the first orifice 210C is located and the inner wall on the opposite side and are fixed thereto by welding.

The coolant flowing space inside the housing 200C is divided into at least two abreast coolant flow passages along a direction parallel to the flat pipes, and the flow directions of two adjacent coolant flow passages are opposite. Two adjacent coolant flow passages are communicated with each other through the corresponding bridge region 430C at a turning point.

One or more columns of circulation holes 1211C are evenly distributed on the cross section of each flat pipe to form refrigerant flow passages 610C. The circulation holes 1211C are preferably circular or in other shapes. A hydraulic diameter of each circulation hole 1211C preferably ranges from 0.3 mm to 1.5 mm, a distance between the centers of two adjacent circulation holes is preferably 0.5 mm to 2.5 mm, and the width of each flat pipe preferably ranges from 20 mm to 60 mm. It is conceivable that, the number of the flat pipes can be further increased or decreased, which depends on actual needs, and in width direction, the flat pipe may be realized by two or more abreast flat pipes. In other words, in the longitudinal direction shown in the figure, two or more layers of flat pipes may be arranged.

The first end plate 114C-1 and the second end plate 114C-2 have the same structure, and both have three blocking portions corresponding to each flow collecting passage 1101C, and each blocking portion is divided into an outer semicircular portion 1141C and an inner semicircular portion 1142C, where the outer semicircular portion 1141C has a larger diameter than the inner semicircular portion 1142C, and the three outer semicircular portions 1141C are connected as a whole. With this structure, the inner shapes of the first end plate 114C-1 and the second end plate 114C-2 are able to match the cross-sectional shapes of the three flow collecting passages 1101C, and the outer shapes are able to match with the shapes of the three arch tops.

If the flow collecting passage 1101C is not a circular hole, but is designed as a hole of other shape, the shape of the inner semicircular portion 1142C may be adjusted according to the shape of the flow collecting passage 1101C, for example, the flow collecting passage may be rectangular or in other shapes. The shape of the outer semicircular portion 1141C may also be adjusted according to the shape of the outer surface.

The flat pipes are accommodated in the housing 200C, and the coolant flowing space is formed inside the housing 200C, which is configured to allow the coolant to flow in and exchange heat with the flat pipes. The flat pipes occupy part of the space inside the housing 200C, and the space outside the flat pipes is part of the coolant flowing space. Coolant flow sub-passages are formed between the flat pipes and between the flat pipes and the inner wall of the housing 200C. The coolant flow sub-passages are provided with fins 620C to enhance the heat transfer effect. A part of the fins 620C are located between adjacent flat pipes, and another part of the fins 620C are located between the flat pipes and the inner wall of the housing 200C. The fins 620C located between the flat pipes and the inner wall of the housing 200C are in contact with the inner wall of the housing 200C and fixed thereto by welding. Two adjacent rows of the fins 620C are staggered. The width of each fin preferably ranges from 0.5 mm to 5 mm, and the period of the fins (pitch of wave) preferably ranges from 3 mm to 8 mm. In addition to the fins 620C, the coolant flowing space may also be designed to have a surface corrugated enhanced heat transfer structure or a dotted-and-corrugated enhanced heat transfer structure.

The number of holes of the flow collecting passages 1101C of the first flow collecting component 110C-1 and the second flow collecting component 110C-2 is preferably 2 to 8, and the diameter of the flow collecting passages 1101C preferably ranges from 5 mm to 25 mm, and the cross section of the flow collecting passages 1101C is preferably circular or oval.

The coolant inlet 410C and the coolant outlet 420C are located at the top of the second adapter block 520C, and the coolant inlet 410C and the coolant outlet 420C may be arranged at one of the four corners of the heat exchange device. The first fluid port 101C and the second fluid port 102C may be arranged on different sides, and the arrangement is relatively flexible. Moreover, the coolant or the refrigerant may enter from above the housing 200C and flow out from below the housing 200C or may flow in from below the housing 200C and flow out from above the housing 200C.

If the coolant is in three or more flow paths, the distribution region 440C, the collecting region 450C and the bridge region 430C may be separated by a corresponding number of ribs and separators.

The center of the pipe of the distribution region 440C may deviate outward from the center of the corresponding first coolant flow passage. Similarly, the center of the pipe of the collecting region 450C may deviate outward from the center of the corresponding second coolant flow passage.

The bridge region 430C has an open portion facing downwards to the flat pipes. One half of the open portion is communicated with the first coolant flow passage at a tail end, and the other half of the open portion is communicated with the second coolant flow passage at a head end. After passing through the bridge region 430C from the first coolant flow passage, the coolant flows into the second coolant flow passage, and the flow direction is reversed, so that the flow directions of the two coolant flow passages are opposite.

The bridge region 430C extends laterally above the flat pipes, and the projection of the bridge region is generally rectangular, and partially overlaps with the corresponding flat pipes in the projection direction. In this way, all flow passages in the first coolant flow passage are able to completely communicate with all flow passages in the second coolant flow passage, to avoid the occurrence of not communicated "dead flow passage" regions.

The size of the bridge region 430C is proportional to the aperture of the coolant inlet and the coolant outlet, and the cross sectional area of the bridge region 430C is slightly larger than the cross sectional area of the connecting pipes of the coolant inlet and the coolant outlet. Moreover, the bridge region 430C may not be arranged on the upper surface of the housing 200C, but on the lower surface of the housing 200C. If multiple coolant flow passages are arranged, part of the bridge region 430C may be provided on the upper surface of the housing 200C, and the other part of the bridge region 430C may be provided on the lower surface of the housing 200C. The bridge region 430C may be rectangular or in other shapes such as an irregular shape.

As can be seen from FIGS. 16, 17, and 18, after the flat pipes are installed inside the housing 200C, the top of the flat pipes and the inner top surface of the housing 200C are almost bonded together, and the bottom of the flat pipes and the inner bottom surface of the housing 200C are also almost bonded together. Since the coolant flow sub-passages formed by the flat pipes inside the housing 200C are communicated in the lateral direction only through a small gap, these sub-passages are almost isolated from each other. The projection of the distribution region 440C laterally covers almost half of the coolant flow sub-passages, and these coolant flow sub-passages together form the first coolant flow passage. The coolant is able to flow into the coolant flow sub-passages of the first coolant flow passage through the distribution region 440C. The projection of the collecting region 450C laterally covers the other half of the coolant flow sub-passages, and these coolant flow sub-passages together form the second coolant flow passage. The coolant flowing out of the coolant flow sub-passages of the second coolant flow passage is able to flow to the outlet collecting region 450C, and finally flow out from the outlet.

The number of the coolant flow sub-passages of the first coolant flow passage in the width direction (the left-and-right direction shown in the figure) depends on the width of the distribution region 440C, and the number of the coolant flow sub-passages of the second coolant flow passage depends on the width of the collecting region 450C.

Figure 26:
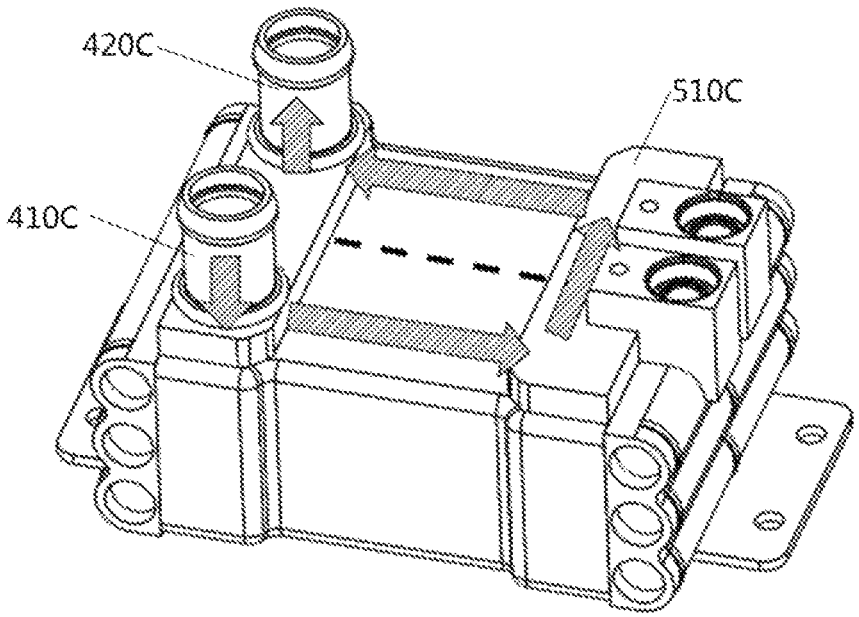
FIG. 26 is a schematic diagram of the coolant divided into two flows.
Figure 27:
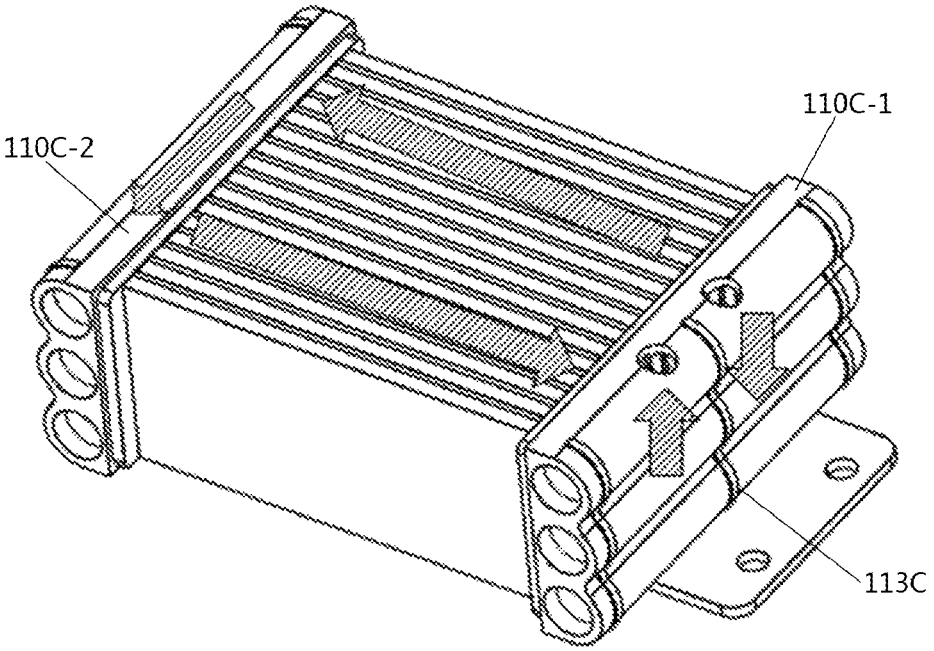
FIG. 27 is a schematic diagram of the refrigerant divided into two flows.

Referring to FIGS. 26 and 27, FIG. 26 is a schematic diagram of the coolant divided into two flows; FIG. 27 is a schematic diagram of the refrigerant divided into two flows.

As shown in the figures, during operation, the coolant flows from the coolant inlet 410C into the distribution region 440C, and then is distributed into the fins of the first coolant flow passage, and flows to the opposite side along the direction of the arrow, and then passes through the bridge region 430C and enters the fins of the second coolant flow passage, and finally flows to the outlet collecting region 450C and flows out from the coolant outlet 420C.

The refrigerant enters the flow collecting passage 1101C of the first flow collecting portion 110C-11 of the first flow collecting component 110C-1 from the first port of the first port seat 310C, and then enters the second flow collecting component 110C-2 through the first flat pipe group 120C-1, and then enters the second flat pipe group 120C-2 from the flow collecting passage 1101C of the second flow collecting component 110C-2, and enter the flow collecting passage 1101C of the second flow collecting portion 110C-12 of the first flow collecting component 110C-1, and flows out from the second port of the second port seat 320C.

The above embodiment is only a preferred solution of the present disclosure, and the present disclosure is not specifically limited thereto. On this basis, targeted adjustments can be made according to actual needs, thereby obtaining different embodiments. For example, the flow collecting passages 1101C are vertically distributed and parallel to the flat pipes 3 together with the separator 113C; or, the outer surfaces of the first flow collecting component 110C-1 and the second flow collecting component 110C-2 are flat and do not have arch tops; or, the coolant flows reversely or the refrigerant flows reversely, and so on. Since there are many possible implementations, no more examples will be given herein.

By dividing the flow collecting cavities of the first flow collecting component 110C-1 and the second flow collecting component 110C-2 into multiple flow collecting passages, the multiple collecting flow passages are combined to bear a pressure from the medium together. Compared with a structure of a single inner cavity, the flow collecting component with multiple flow collecting passages is able to enhance the pressure resistance of the heat exchange device, so that the heat exchange device can bear higher refrigerant pressure, and can be safely and reliably applied for the $CO_2$ refrigerant without increasing the wall thickness, weight and volume.

In addition, since a flow path of the refrigerant is divided into at least two refrigerant flow paths, the flow path of the refrigerant can be extended and the heat exchange performance can be improved. Sealing the two ends of the flow collecting component by inserting the separator can bear greater pressure than directly welding plugs to the two ends.

Embodiment 4

Figure 28:
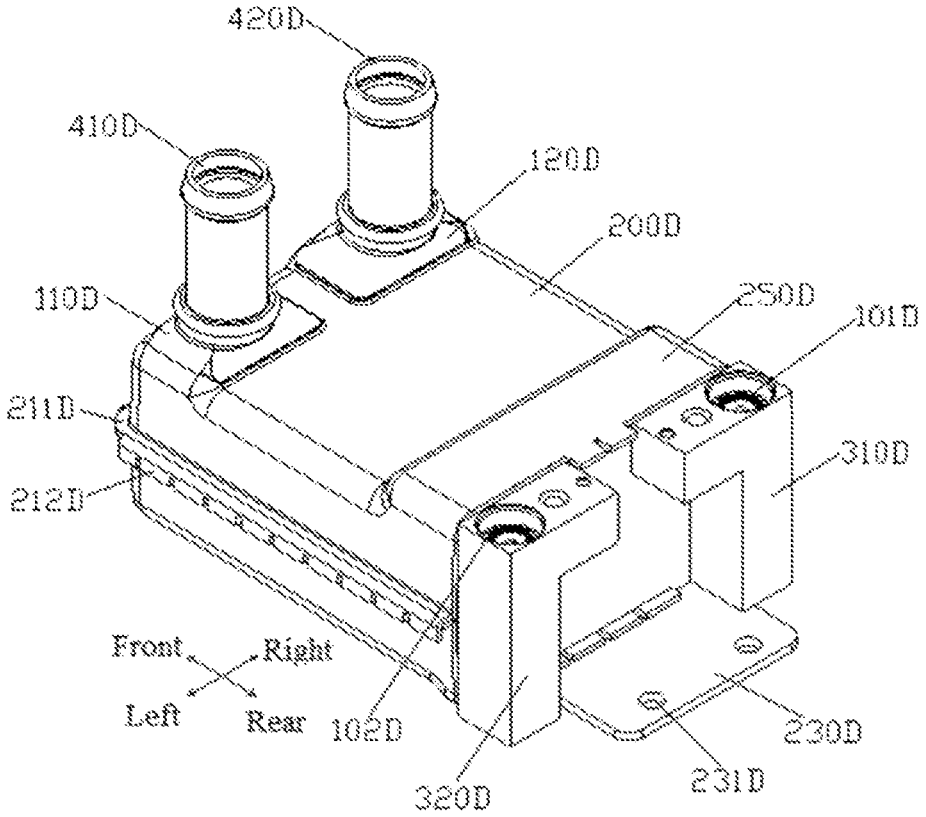
FIG. 28 is a schematic structural view of a fourth embodiment of the heat exchange device according to the present disclosure.
Figure 29:
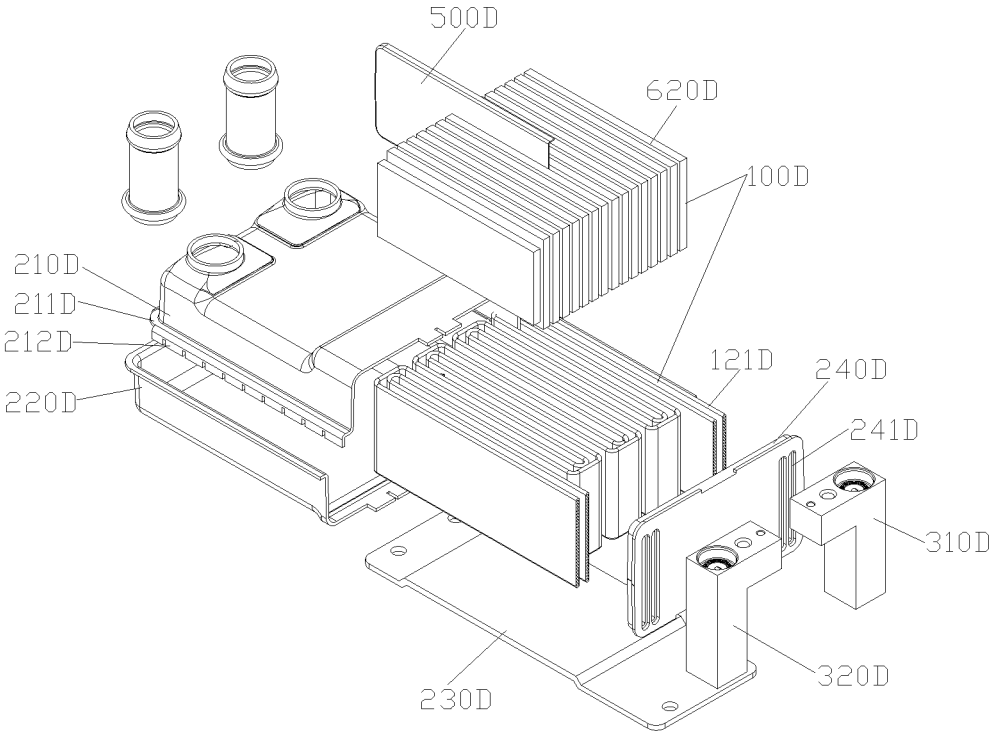
FIG. 29 is an exploded structural view of the heat exchange device shown in FIG. 28.
Figure 30:
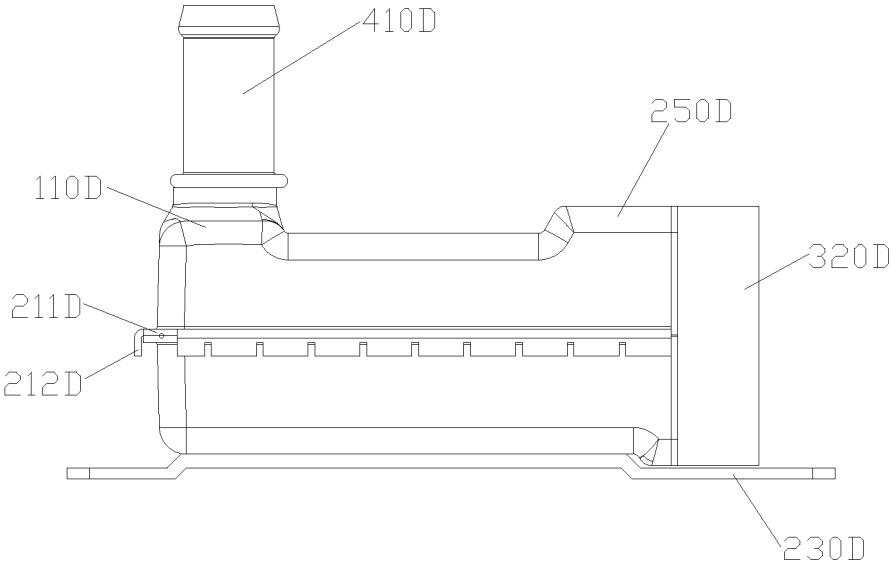
FIG. 30 is a partial side view of the separation device shown in FIG. 28.
Figure 31:
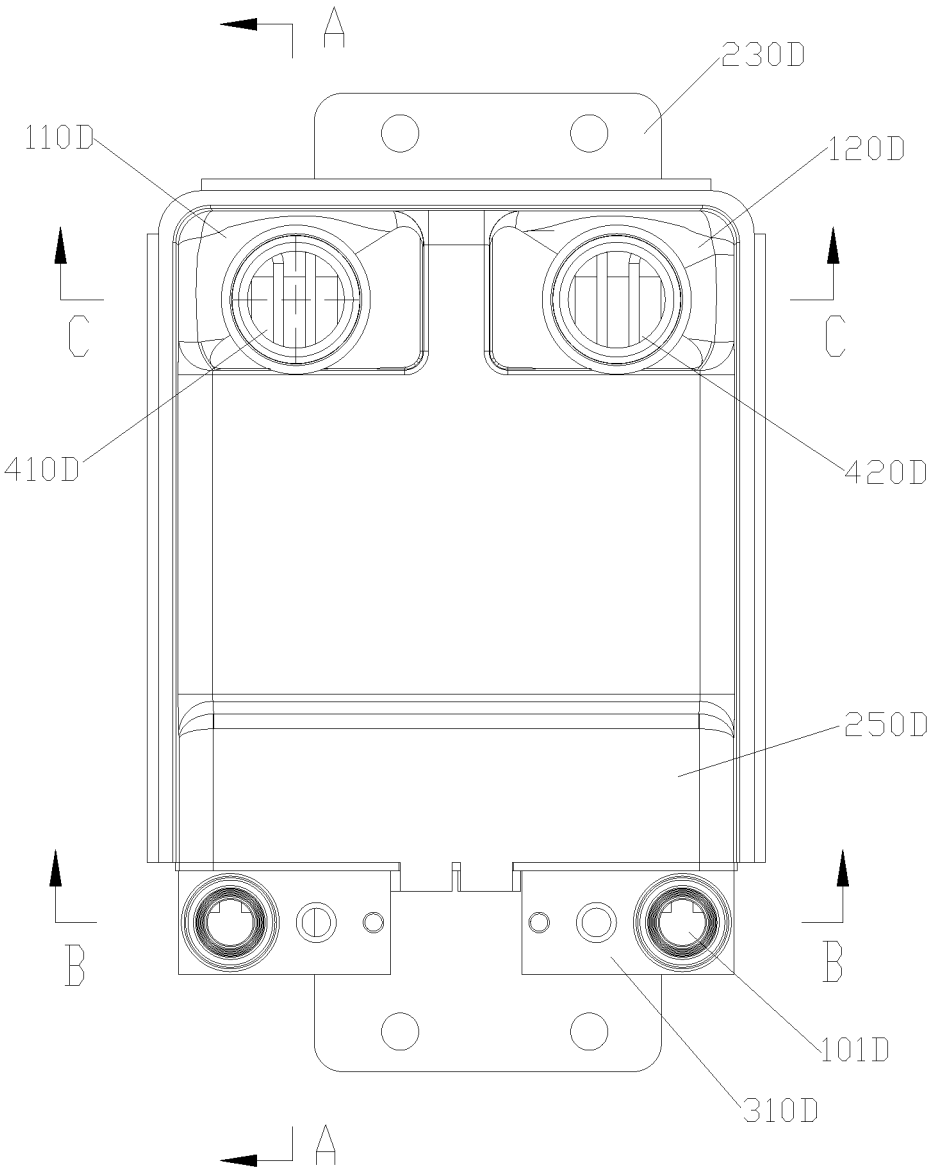
FIG. 31 is a top view of the heat exchange device in FIG. 28.

Referring to FIGS. 28, 29 and 30, FIG. 28 is a schematic structural view of a fourth embodiment of the heat exchange device according to the present disclosure; FIG. 29 is an exploded structural view of the heat exchange device shown in FIG. 28; FIG. 30 is a partial side view of the separation device shown in FIG. 28.

In this embodiment, the heat exchange device according to the present disclosure is a heat exchange device applicable for $CO_2$ refrigerant. Compared with the conventional $CO_2$ heat exchange device, the heat exchange device has higher heat exchange efficiency and strong pressure-bearing capacity. Moreover, the heat exchange device is easy to assemble and process, and has light weight and low cost.

As shown in the figures, the heat exchange device mainly includes a core 100D and a housing 200D. The bottom of the housing 200D is provided with an installation plate 230D, and two ends of the installation plate 230D extend a certain distance from the housing in a front-and-rear direction, and are provided with installation holes 231D. There is no other parts blocking the axial direction of the installation holes 231D, which facilitates the installation operation.

The core 100D includes two abreast flat pipes 121D which are continuously bent back and forth along a serpentine path, and the two flat pipes 121D both have multiple mutually parallel straight portions 1212D and multiple bent portions 1213D that transitionally connect two adjacent straight portions. One of the flat pipes 121D is an outer flat pipe, and the other one of the flat pipes 121D is an inner flat pipe. Since the outer flat pipe is located on the outside, bending amplitude of the bent portion of the outer flat pipe is relatively large, and has an end flat portion and arc portions connecting the end flat portion with the two adjacent straight portions 1212D, and a central angle of the arc portion is 90 degrees. Since the inner flat pipe is located on the inside, the bending amplitude of the bent portion of the inner flat pipe is relatively small, and may only have an arc portion connecting with the two adjacent straight portions 1212D, and the central angle of the arc portion is 180 degrees. Apparently, the bent portion of the outer flat pipe may have an arc shape with a central angle of 180 degrees, and similarly, the bent portion of the inner flat pipe may also have an end flat portion.

It is not difficult to understand that the flat pipe component may not be composed of two abreast flat pipes 121D, but may be formed by one flat pipe 121D continuously bent in the above manner, or may be formed by three or more flat pipes 121D abreast arranged in the above manner and continuously bent together. In other words, the number of the flat pipes 121D may be further increased or decreased, which depends on actual needs.

Figure 33:
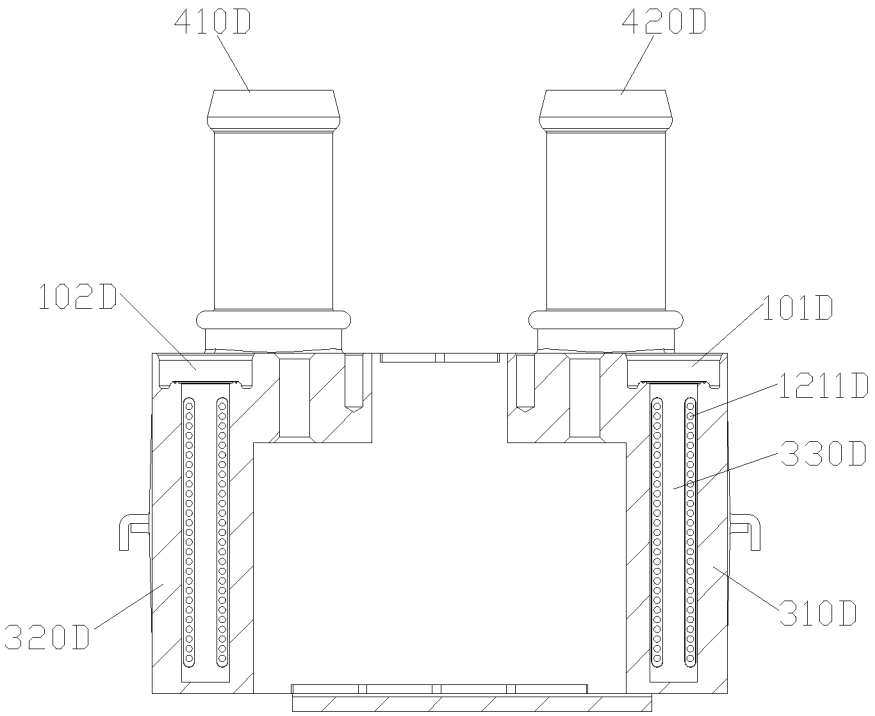
FIG. 33 is a sectional view of FIG. 31 taken along line B-B.

For the structure of the flat pipes 121D, reference is made to FIG. 33. One or more columns of circulation holes 1211D are evenly distributed on the cross section of each flat pipe to form refrigerant flow passages. The circulation holes 1211D are preferably circular or in other shapes. A hydraulic diameter of each circulation hole 1211D preferably ranges from 0.3 mm to 1.5 mm, a distance between the centers of two adjacent circulation holes is preferably 0.5 mm to 2.5 mm, and the width of each flat pipe preferably ranges from 20 mm to 60 mm. In width direction, the flat pipe component may be realized by two or more abreast flat pipes 121D. In other words, in the longitudinal direction shown in the figure, two or more layers of flat pipes 121D may be arranged.

Since the flat pipes 121D are continuously bent in a serpentine shape, the formed refrigerant flow passage has multiple flow paths accordingly. Each time the flat pipes 121D are bent, a reverse flow path is added. The flat pipes 121D shown in the figure have a total of seven bent portions, forming eight flow paths to improve heat exchange efficiency.

The flat pipes 121D bent in a serpentine shape are accommodated in the housing 200D, and the coolant flowing space is formed inside the housing 200D, which is configured to allow the coolant to flow in and exchange heat with the flat pipes 121D. The flat pipes 121D occupy part of the space inside the housing 200D, and the space outside the flat pipes 121D is part of the coolant flowing space. The coolant flowing space is formed between the straight portions 1212D of the flat pipes 121D, formed between the bent portions 1213D of the flat pipes 121D, and formed between the flat pipes 121D and the inner surface of the housing 200D. The coolant flowing space formed between the straight portions 1212D and the coolant flowing space formed between the straight portions 1212D and the side wall of the housing 200D are provided with provided with fins 620D to enhance the heat transfer effect. In addition to the fins 620D, the coolant flowing space may also be designed to have a surface corrugated enhanced heat transfer structure or a dotted-and-corrugated enhanced heat transfer structure.

The refrigerant flow passages of the flat pipes 121D are isolated from the coolant flowing space, the coolant inlet 410D and the coolant outlet 420D are of the heat exchange device are arranged on a same side (front top) of the housing 200D, and the refrigerant inlet 101D and the refrigerant outlet 102D are also arranged on a same side (rear end) of the housing 200D, and the refrigerant inlet 101D and the refrigerant outlet 102D may be arranged on different sides, and the coolant inlet 410D and the coolant outlet 420D may be arranged at one of the four corners of the heat exchange device, and the arrangement is relatively flexible. Moreover, the coolant or the refrigerant may enter from above the housing 200D and flow out from below the housing 200D.

The housing 200D includes an upper housing 210D and a lower housing 220D. The upper housing 210D and the lower housing 220D are provided with a snap structure and are connected by welding. After the core 100D is assembled, the core 100D is put into the housing 200D, and then put into a tunnel furnace or a vacuum furnace for welding.

Specifically, the upper housing 210D and the lower housing 220D are provided with outer flanges 211D connected by welding, where the three outer flanges of the upper housing 210D are provided with serrated protrusions 212D. After the upper housing 210D is assembled with the lower housing 220D, the serrated protrusions 212D are crimped against the outer flanges 211D of the lower housing 220D from the outside by a pressing tool before welding, and the heat device is directly assembled into one piece, which simplifies the welding tooling and ensures that the upper and lower housings are in flush contact, and improves the welding quality. The arrangement of the multiple serrated protrusions 212D can facilitate the realization of the flattening process.

Figure 37:
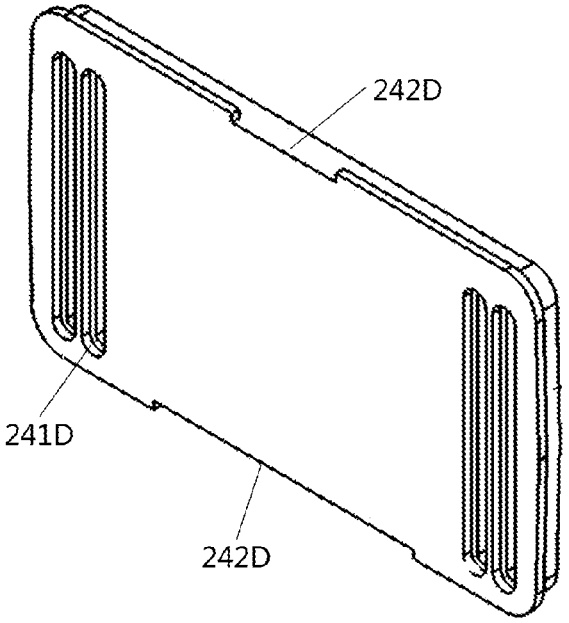
FIG. 37 is a schematic structural view of a flange plate shown in FIG. 29.

Referring to FIG. 37, FIG. 37 is a schematic structural view of a flange plate shown in FIG. 29.

As shown in the figure, after the upper housing 210D is assembled with the lower housing 220D, the leading ends of the flat pipes are open. The open ends are provided with a flange plate 240D, and the upper and lower housings are connected to a bonding surface of the flange plate 240D by welding. The ends of the flat pipes 121D pass through the flange plate 240D to communicate with a refrigerant inlet connecting seat 310D and a refrigerant outlet connecting seat 320D on the flange plate.

A plane where the weld seams of the upper and lower housings are located is perpendicular to a plane where the weld seams of the upper and lower housings and the flange plate 240D are located. The welding of the two mutually perpendicular planes isolates the coolant flowing space from the outside, forming the sealed housing 200D, which can bear the high pressure generated by the $CO_2$ refrigerant during operation without leakage.

Holes on the outer surface of the flange plate 240D allowing the flat pipes 121D to pass through are oblong counterbores 241D. The refrigerant inlet and outlet connecting seats are in an inverted "L" shape, and the two are symmetrically arranged on the outer surface of the flange plate 240D, and vertical portions of the connecting seats are provided with tunnels 330D allowing the refrigerant to flow in and out, and two insertion holes for inserting the flat pipes 121D are respectively provided on a surface that abuts against the flange plate 240D. The flat pipes 121D led out from the interior of the housing 200D are inserted into the refrigerant inlet and outlet connecting seats for a certain distance, and are communicated with the tunnels 330D that are connected to the refrigerant inlet and outlet and allow the refrigerant to flow in and out. Horizontal portions of the refrigerant inlet and outlet are provided with a longitudinal through hole and a counterbore. The hole depth of the oblong counterbore 241D on the flange plate 240D is equal to a wire diameter of a welding ring used during welding. After assembly, the flange plate can form a cavity accommodating the welding ring together with the refrigerant inlet and outlet connecting seats. This cavity can prevent the solder from flowing around during welding, and ensure the solder flows into the gap to ensure the quality of the weld seam, and improve the pressure resistance.

After welding, the flat pipes 121D are connected to the refrigerant inlet and outlet connecting seats by welding, and the flat pipes 121D are connected to the flange plate 240D by welding, and the refrigerant inlet and outlet connecting seats are also connected to the flange plate 240D by welding. This flat pipe-connecting seat-flange plate welded structure can effectively improve the pressure resistance and prevent the high pressure $CO_2$ refrigerant from lead-out portions of the flat pipes.

In addition, notches 242D are respectively provided on an upper edge and a lower edge of the flange plate 240D in the middle, where the length of the notch of the lower edge is greater than the length of the notch of the upper edge. The edges of ports of the upper and lower housings are respectively provided with serrated protrusions 212D that are able to wrap the flange plate 240D from the notches 242D after being bent.

Since welding surfaces formed by the outer flanges 211D are added on the basis of welding, the strength of the housing is strengthened after welding. Moreover, since the existence of the snap structure, the relative position of the heat exchange device before entering the furnace for welding has been fixed, which can save investment in welding tooling, save the tooling for fixing the periphery of the housing and the flange plate 240D, realizing the purpose of strengthening welding, self-fixing, and saving welding tooling.

The coolant flowing space inside the housing 200D is divided into two abreast coolant flow passages along a direction parallel to the straight portions of the flat pipes 121D, and the widths of the two coolant flow passages in the left-and-right direction are substantially the same, and the flow directions are opposite. The housing 200D is provided with a protrusion 250D, and the two coolant flow passages are communicated with each other through an inner cavity 252D of the protrusion 250D at a turning point.

Figure 32:
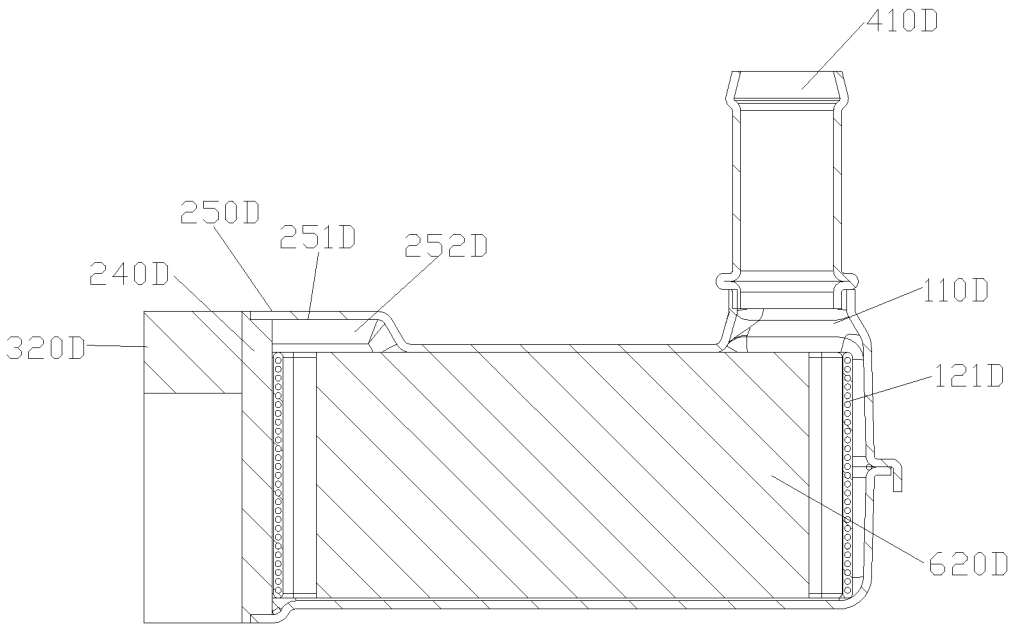
FIG. 32 is a sectional view of FIG. 31 taken along line A-A.
Figure 34:
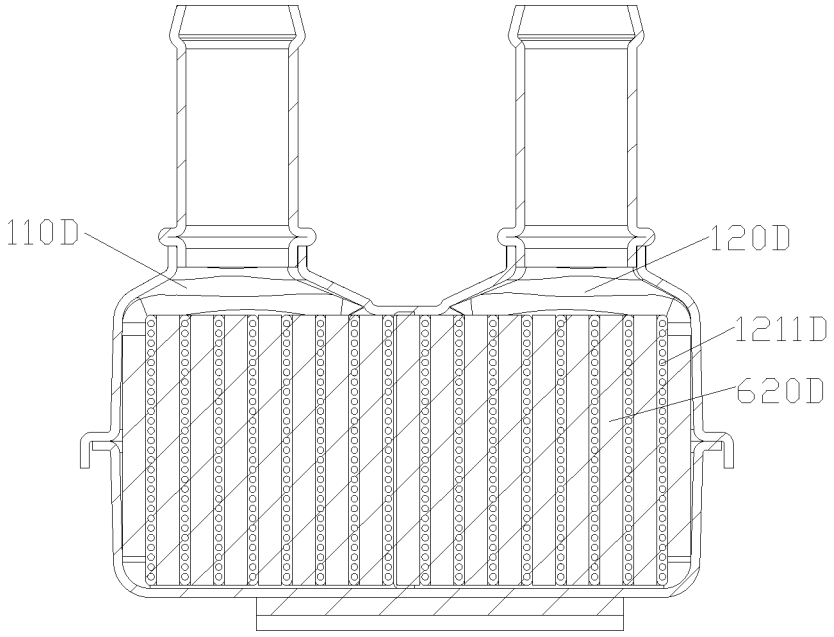
FIG. 34 is a sectional view of FIG. 31 taken along line C-C.
Figure 35:
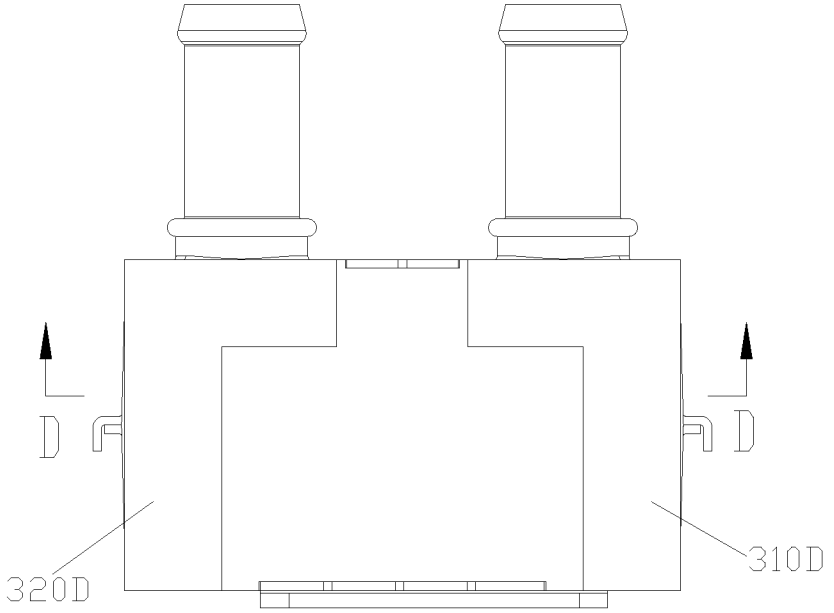
FIG. 35 is a schematic view of an end portion, provided with a refrigerant inlet connecting seat and a refrigerant outlet connecting seat, of the heat exchange device shown in FIG. 28.
Figure 36:
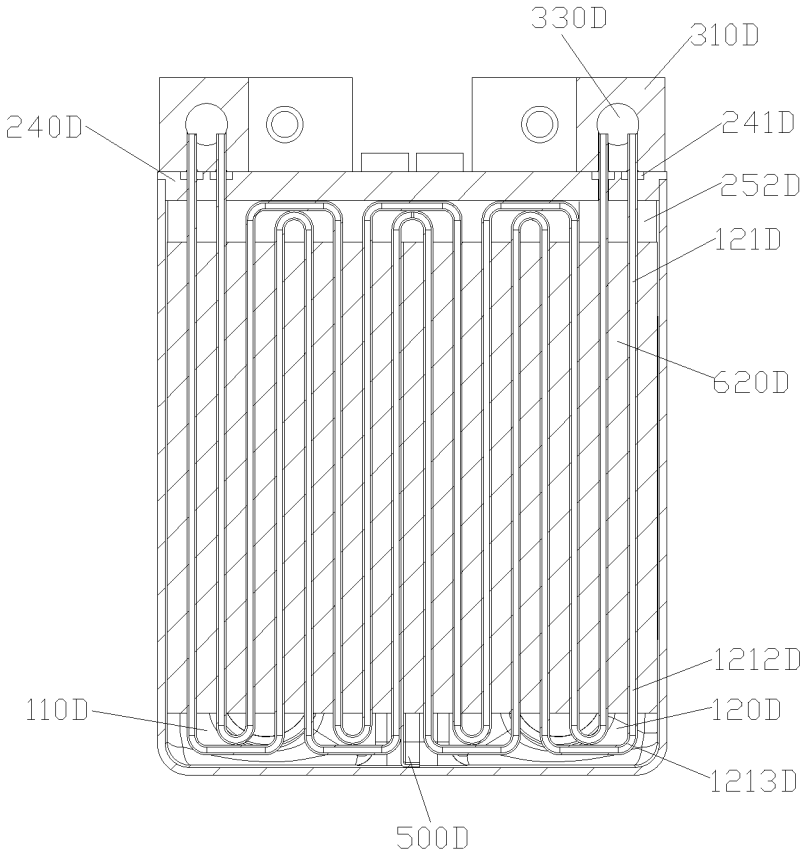
FIG. 36 is a sectional view of FIG. 35 taken along line D-D.

Referring to FIGS. 31 to 36, FIG. 31 is a top view of the heat exchange device in FIG. 28; FIG. 32 is a sectional view of FIG. 31 taken along line A-A; FIG. 33 is a sectional view of FIG. 31 taken along line B-B; FIG. 34 is a sectional view of FIG. 31 taken along line C-C; FIG. 35 is a schematic view of an end portion, provided with a refrigerant inlet connecting seat and a refrigerant outlet connecting seat, of the heat exchange device shown in FIG. 28; FIG. 36 is a schematic sectional view of FIG. 35 taken along line D-D.

As shown in the figures, the housing 200D is provided with the hollow protrusion 250D at the turning point of the two coolant flow passages. The hollow protrusion 250D is provided on the upper housing 210D, above the turning point of the flat pipes 121D. The inner cavity 252D of the hollow protrusion 250D transitionally communicates with two coolant flow passages.

The inner cavity 252D has an open portion facing downwards to the flat pipes 121D. One half of the open portion is communicated with the first coolant flow passage at a tail end, and the other half of the open portion is communicated with the second coolant flow passage at a head end. After passing through the inner cavity 252D from the first coolant flow passage, the coolant flows into the second coolant flow passage, and the flow direction is reversed, that is, the flow directions of the two coolant flow passages are opposite.

The inner cavity 252D extends laterally above the flat pipes 121D, and the projection of the inner cavity is generally rectangular, and overlaps with the bent portions 1213D and part of the straight portions 1212D of the flat pipes of the communicated two coolant flow passages in the projection direction (see FIG. 36), that is, the projection of the bent portions of the flat pipes 121D close to the protrusion 250D on the side of the protrusion 250D of the housing 200D is located on the protrusion 250D, and at least part of the projection of the straight portions of the flat pipes 121D close to the protrusion 250D on the side of the protrusion 250D of the housing 200D is located on the protrusion 250D. In this way, all flow passages in the first coolant flow passage are able to completely communicate with all flow passages in the second coolant flow passage, to avoid the occurrence of not communicated "dead flow passage" regions.

The size of the protrusion 250D is proportional to the aperture of the coolant inlet and the coolant outlet, and the cross sectional area of the inner cavity 252D in the protrusion is slightly larger than the cross sectional area of the connecting pipes of the coolant inlet and the coolant outlet. Moreover, the protrusion 250D may not be arranged on the upper housing 210D, but on the lower housing 220D. If multiple coolant flow passages are arranged, part of the protrusion 250D may be provided on the upper housing 210D, and the other part of the protrusion 250D may be provided on the lower housing 220D. The protrusion 250D may be rectangular or in other shapes such as an irregular shape.

The housing 200D is provided with a hollow inlet first flow collecting structure 110D and a hollow outlet second flow collecting structure 120D, and the inlet first flow collecting structure 110D and the outlet second flow collecting structure 120D are located on a side of housing 200D opposite to the protrusion 250D. The projection of the bent portions of the flat pipes 121D close to the inlet first flow collecting structure 110D on the side of the inlet first flow collecting structure 110D of the housing 200D is located in the inlet first flow collecting structure 110D. The projection of the bent portions of the flat pipes 121D close to the outlet second flow collecting structure 120D on the side of the outlet second flow collecting structure 120D of the housing 200D is located in the outlet second flow collecting structure 120D. At least part of the projection of the straight portions of the flat pipes 121D close to the inlet first flow collecting structure 110D on the side of the inlet first flow collecting structure 110D of the housing 200D is located in the inlet first flow collecting structure 110D. At least part of the projection of the straight portions of the flat pipes 121D close to the outlet second flow collecting structure 120D on the side of the outlet second flow collecting structure 120D of the housing 200D is located in the outlet second flow collecting structure 120D.

As can be seen from FIGS. 32, 34, and 36, after the flat pipes 121D are continuously bent and put into the housing 200D, a small gap is left between the bent portions 1213D at the front and the inner surface of the front wall of the housing 200D, the bent portions 1213D at the rear end and the flange plate 240D are almost bonded together, the top of the flat pipes and the inner top surface of the housing 200D are almost bonded together, and the bottom of the flat pipes and the inner bottom surface of the housing 200D are also almost bonded together. Since the flow passages divided and formed by the flat pipes 121D inside the housing 200C are communicated in the lateral direction only through a small gap, these flow passages are almost isolated from each other. Therefore, all the flow passages corresponding to the inlet first flow collecting structure 110D of the housing can form a first coolant flow passage after being laterally communicated through the inlet first flow collecting structure 110D. The coolant can flow into each flow passage through the inlet first flow collecting structure 110D. All the flow passages corresponding to the outlet second flow collecting structure 120D of the housing 200D can form a second coolant flow passage after being laterally communicated through the outlet second flow collecting structure 120D. The coolant flowing out from the flow passages of the second coolant flow passage can flow to the outlet second flow collecting structure 120D, and finally flow out from the coolant outlet 420D.

The housing 200D is provided with a rib for separating between the inlet first flow collecting structure 110D and the outlet second flow collecting structure 120D, thereby ensuring that the coolant at the inlet only enters the first coolant flow passage, and the coolant at the outlet only comes from the second coolant flow passage.

In order to ensure that the first coolant flow passage and the second coolant flow passage are separated from each other and to avoid short circuit of the coolant between different flow paths, a baffle plate 500D may be inserted in the middle of the core.

The baffle plate 500D is provided at the separation of the two coolant flow passages in the housing 200D. The baffle plate 500D is parallel to the straight portions 1212D of the flat pipes 121D. Two adjacent coolant flow passages are located on two sides of the baffle plate 500D. The baffle plate 500D is fixed to the inner wall of the housing 200D by welding. At least a part of the baffle plate 500D is located in a region between the inlet first flow collecting structure 110D and the outlet second flow collecting structure 120D.

The baffle plate 500D is inserted between the straight portions of the flat pipes at the separation of the coolant flow passages, upper and lower edges of the baffle plate are respectively connected with the upper and lower surfaces of the inner surface of the housing 200D, a front edge of the baffle plate is connected with the side wall of the inner surface of the housing 200D, and a certain distance is left between a rear edge of the baffle plate and the bent portions 1213D of the flat pipes 121D. A certain distance is left between a side of the baffle plate 500D close to the protrusion 250D and the inner top surface 251D of the protrusion 250D. If the protrusion 250D is provided on the lower housing 220D, a certain distance is kept between a side of the baffle plate 500D close to the protrusion 250D and the inner bottom surface of the protrusion 250D.

Figure 38:
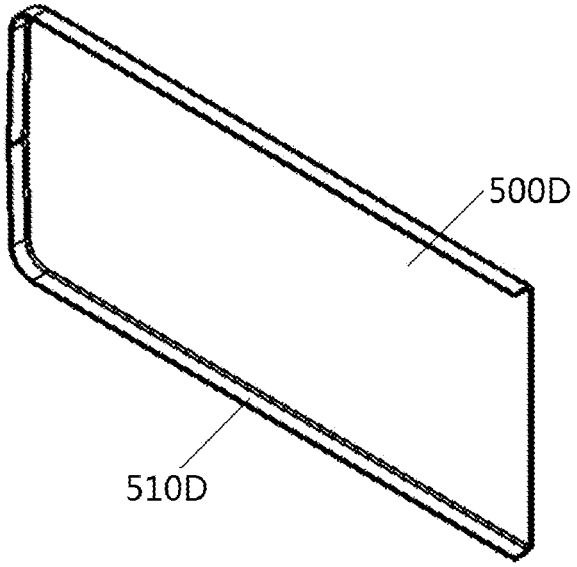
FIG. 38 is a schematic structural view of a baffle plate shown in FIG. 29.

Referring to FIG. 38, FIG. 38 is a schematic structural view of a baffle plate shown in FIG. 29.

As shown in the figure, the upper edge, the lower edge and the front edge of the baffle plate 500D are provided with flanges 510D to form welding surfaces, and are connected to the inner surface of the housing 200D through the flanges 510D. The area of the welding surfaces can be increased through the flanges 510D. Under the premise of realizing the function of the baffle plate, the internal pressure-bearing capacity of the housing is increased, and the internal pressure resistance of the housing 200D is improved.

If the coolant is in three or more flow paths, the inlet first flow collecting structure 110D, the outlet second flow collecting structure 120D, and the protrusion 250D may be separated by a corresponding number of ribs and separators.

Figure 39:
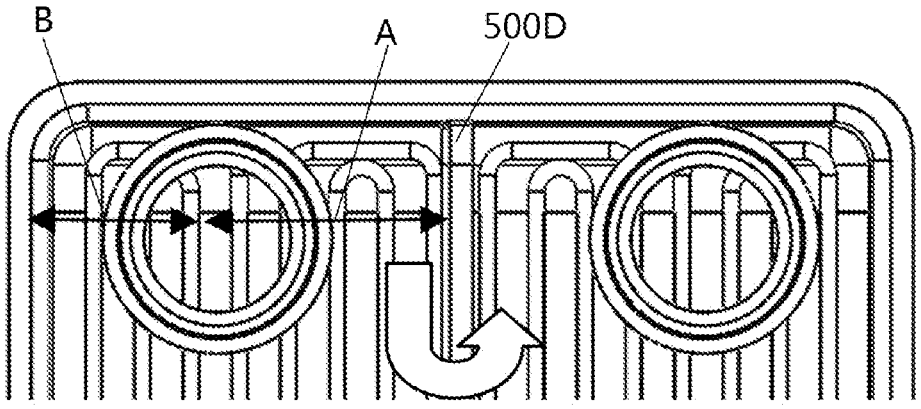
FIG. 39 is a schematic view of principle analysis of a water pipe center of a first coolant collecting structure relatively deviating from the center of a first coolant flow passage to prevent the coolant from being short-circuited from the innermost side.

Referring to FIG. 39, FIG. 39 is a schematic view of principle analysis of a water pipe center of a first coolant collecting structure relatively deviating from the center of a first coolant flow passage to prevent the coolant from being short-circuited from the innermost side.

As shown in the figure, the housing 200D is provided with the coolant inlet 410D and the coolant outlet 420D. The coolant inlet 410D is provided with the inlet first flow collecting structure 110D, and the center of the coolant inlet 410D deviates outward from the center of the inlet first flow collecting structure 110D, that is, the distance A in the figure is greater than the distance B; similarly, the coolant outlet 420D is provided with the outlet second flow collecting structure 120D, and the center of the coolant outlet 420D deviates outward from the center of the outlet second flow collecting structure 120D.

As shown in FIG. 34, a cavity of the inlet first flow collecting structure 110D gradually expands from the coolant inlet 410D to the interior of the housing, with a smooth and gradual transition inside. The slope of an inner wall of the cavity of the inlet first flow collecting structure on a side close to the outlet second flow collecting structure 120D is smaller than the slope of the inner wall of the cavity of the inlet first flow collecting structure on a side away from the outlet second flow collecting structure 120D. Similarly, a cavity of the outlet second flow collecting structure 120D gradually shrinks from the interior of the housing to the coolant outlet 420D. The slope of an inner wall of the cavity of the outlet second flow collecting structure on a side close to the inlet first flow collecting structure 110D is smaller than the slope of the inner wall of the cavity of the outlet second flow collecting structure on a side away from the inlet first flow collecting structure 110D.

With this arrangement, the circulation passage close to the baffle plate 500D is small and the flow resistance therein is large, which reduces the short-circuit water flow from the innermost side (as shown by the arrow), and allows the coolant to flow to the outside, thereby realizing a more even distribution of the coolant in the flow paths.

The above embodiment is only a preferred solution of the present disclosure, and the present disclosure is not specifically limited thereto. On this basis, targeted adjustments can be made according to actual needs, thereby obtaining different embodiments. For example, the refrigerant flow passage may have other micro-channel structures, or an integrated housing 200D (such as 3D printed housing) is welded or riveted to the flange plate 240D, or the coolant flows reversely or the refrigerant flows reversely, and so on. Since there are many possible implementations, no more examples will be given herein.

The heat exchange device can not only extend the flow path of the coolant, but also increase the flow rate of the coolant at the same flow, so that the heat transfer coefficient of the coolant is increased, and the heat exchange efficiency is significantly improved. Moreover, by eccentrically arranging the inlet first flow collecting structure 110D and the outer second flow collecting structure 120D, the distribution of the coolant can be more even. Through the triple welding of flat pipe-flange plate-connecting seat, the two perpendicular circles of welding of the flanges of the baffle plate and the housing, and the snap structure with serrated protrusions of the housing, the capacity of the heat exchange device to bear higher pressure of the $CO_2$ refrigerant can be improved, to ensure the sealing performance and avoid leakage. Compared with the technical solution of simply increasing the thickness of the parts to improve the pressure-bearing capacity, the heat exchange device according to the present disclosure has the advantages of small size, light weight and low cost.

The heat exchange device according to the present disclosure is described in detail hereinbefore. The principle and the embodiments of the present disclosure are illustrated herein by specific examples. The above description of the examples is only intended to facilitate the understanding of the concept of the present disclosure. It should be noted that, for the person skilled in the art, various improvements and modifications may be further made to the present disclosure without departing from the principles of the present disclosure, and these improvements and modifications also fall within the scope of claims of the present disclosure.

What we claim is:

1. A heat exchange device, comprising a core and a housing, wherein the core comprises a first flow collecting component and a second flow collecting component which are oppositely arranged, and a flat pipe component is provided between the first flow collecting component and the second flow collecting component;

the flat pipe component comprises a first flat pipe group and a second flat pipe group, and the first flat pipe group and the second flat pipe group both comprise a plurality of flat pipes, and two ends of each flat pipe are respectively communicated with the first flow collecting component and the second flow collecting component;

two end portions of the housing are respectively fixedly connected to the first flow collecting component and the second flow collecting component, the flat pipe component is located in the housing, and a coolant flowing space is formed in the housing;

the second flow collecting component has a flow collecting cavity, and the flow collecting cavity of the second flow collecting component has two or more abreast flow collecting passages communicated with each other;

the first flow collecting component has a flow collecting cavity, the first flow collecting component comprises a first flow collecting portion and a second flow collecting portion, and a separator is provided between the first flow collecting portion and the second flow collecting portion; each flat pipe of the first flat pipe group is communicated with the flow collecting cavity of the first flow collecting portion; each flat pipe of the second flat pipe group is communicated with the flow collecting cavity of the second flow collecting portion; the flow collecting cavity of the first flow collecting portion is communicated with the flow collecting cavity of the second flow collecting portion through the first flat pipe group, the flow collecting cavity of the second flow collecting component, and the second flat pipe group, the flow collecting cavity of the first flow collecting portion has two or more abreast flow collecting passages communicated with each other, and the flow collecting cavity of the second flow collecting portion has two or more abreast flow collecting passages communicated with each other; the flow collecting passages of the first flow collecting portion are communicated with the flow collecting cavity of the second flow collecting component through the first flat pipe group, and the flow collecting passages of the second flow collecting portion are communicated with the flow collecting cavity of the second flow collecting component through the second flat pipe group, the first flow collecting component comprises a main body component, a first end plate and a second end plate, the flow collecting cavity of the first flow collecting component is located in the main body component, and the first end plate and the second end plate are configured to block two ends of the flow collecting cavity of the first flow collecting component the main body component comprises a first wall portion and a second wall portion;

the first wall portion is provided with a separation groove which faces away from the second wall portion, a shape of the separator matches the separation groove, and the separator is inserted into the separation groove and a corresponding connection portion is sealed, and the separator is configured to divide the first flow collecting component into the first flow collecting portion and the second flow collecting portion;

the flow collecting passages of the first flow collecting portion are arranged in a width direction of the first flow collecting component, the flow collecting passages of the second flow collecting portion are arranged in the width direction of the first flow collecting component;

the second wall portion is provided with a plurality of insertion holes adapted to the flat pipes;

the main body component is provided with a first fluid port and a second fluid port, the first fluid port is communicated with the flow collecting cavity of the first flow collecting portion, and the second fluid port is communicated with the flow collecting cavity of the second flow collecting portion; and the heat exchange device further comprises a first port seat and a second port seat, the first port seat is provided with a first port, and the second port seat is provided with a second port, the first port seat and the second port seat are both fixed to the main body component, the first port is communicated with the flow collecting cavity of the first flow collecting portion through the first fluid port, and the second port is communicated with the flow collecting cavity of the second flow collecting portion through the second fluid port.

2. The heat exchange device according to claim 1, wherein the first flow collecting component comprises a main body component, a first end plate and a second end plate, the flow collecting cavity of the first flow collecting component is located in the main body component, the first end plate and the second end plate are configured to block two ends of the flow collecting cavity of the flow collecting component, and the main body component comprises a first wall portion, a second wall portion, and two side plate portions;

the first wall portion is provided with a separator extending toward the second wall portion and abutting against the second wall portion, and the separator is configured to divide the first flow collecting component into the first flow collecting portion and the second flow collecting portion;

the flow collecting passages of the first flow collecting portion are arranged in a length direction of the first flow collecting component, and the flow collecting passages of the second flow collecting portion are arranged in the length direction of the first flow collecting component; and the second wall portion is provided with a plurality of insertion holes adapted to the flat pipes.

3. The heat exchange device according to claim 2, wherein the first end plate is provided with a first fluid port and a second fluid port, the first fluid port is communicated with the flow collecting cavity of the first flow collecting portion, and the second fluid port is communicated with the flow collecting cavity of the second flow collecting portion;

the heat exchange device further comprises a first port seat and a second port seat, the first port seat comprises a first adapter seat and a first pipe-connecting seat, and the second port seat comprises a second adapter seat and a second pipe-connecting seat; and the first pipe-connecting seat is provided with a first port, the second pipe-connecting seat is provided with a second port, the first pipe-connecting seat is fixed to the first end plate through the first adapter seat, and the second pipe-connecting seat is fixed to the first end plate through the second adapter seat; the first port is communicated with the flow collecting cavity of the first flow collecting portion through the first fluid port, and the second port is communicated with the flow collecting cavity of the second flow collecting portion through the second fluid port.

4. The heat exchange device according to claim 1, wherein the first wall portion is provided with two sealing grooves that face away from the second wall portion, shapes of the first end plate and the second end plate match the sealing grooves, and the first end plate and the second end plate are inserted into the sealing grooves and corresponding connection portions are sealed; and the first end plate and the second end plate are connected to the main body component by welding; the second flow collecting component is provided with insertion holes adapted to the flat pipes, the flat pipes are inserted into the insertion holes of the first flow collecting component at one end and the corresponding connection portions are sealed, and the flat pipes are inserted into the insertion holes of the second flow collecting component at another end and the corresponding connection portions are sealed.

5. The heat exchange device according to claim 1, wherein the flow collecting passage of the first flow collecting component is a passage at least part of which has a shape of a curve protruding outward, and the first wall portion comprises a plurality of curved portions protruding outward, and the curved portions are a part of the wall portions forming the flow collecting passages; the flow collecting passages of the second flow collecting component are arranged in a width direction or a length direction of the second flow collecting component;

the plurality of flat pipes of the first flat pipe group are stacked in the length direction of the first flow collecting component, and the plurality of flat pipes of the second flat pipe group are stacked in the length direction of the first flow collecting component; or the plurality of flat pipes of the first flat pipe group are stacked in the width direction of the first flow collecting component, and the plurality of flat pipes of the second flat pipe group are stacked in the width direction of the first flow collecting component.

6. The heat exchange device according to claim 1, wherein one or more baffle plate is provided in the housing, one end of the baffle plate is kept at a predetermined distance from one of the first flow collecting component and the second flow collecting component, another end of the baffle plate is fixed to the other one of the first flow collecting component and the second flow collecting component, two side portions of the baffle plate are fixed to an inner wall of the housing to divide the coolant flowing space into two or more abreast coolant flow passages communicated with each other, and the two or more coolant flow passages are such configured that two adjacent coolant flow passages are separated at one end and are communicated at another end; the housing has two coolant ports, which are respectively communicated with the two coolant flow passages located outside; and the two coolant ports are respectively formed on two opposite side walls of the housing, and the two side walls are arranged along the length direction of the first flow collecting component.

7. The heat exchange device according to claim 1, wherein the coolant flowing space inside the housing is divided into at least two abreast coolant flow passages along a direction parallel to the flat pipes, and flow directions of the two adjacent coolant flow passages are opposite; the two adjacent coolant flow passages are communicated with each other through the corresponding bridge region at a turning point;

the heat exchange device comprises a first adapter block and a second adapter block, the first adapter block comprises a hollow bridge region, and the second adapter block comprises a hollow distribution region and a hollow collecting region, a separation rib is provided between the distribution region and the collecting region, the housing is provided with a first orifice, a second orifice and a third orifice, the bridge region is communicated with the first orifice, the distribution region is communicated with the second orifice, and the collecting region is communicated with the third orifice, the first adapter block and the second adapter block are fixed to the housing by welding, the first adapter block is close to the first flow collecting component, and the second adapter block is close to the second flow collecting component; and a projection of an end of each flat pipe close to the first orifice on a side of the first orifice of the housing is located in the first orifice, and a projection of an end of each flat pipe away from the first orifice on a side of the second orifice of the housing is located in the second orifice and the third orifice, the flat pipes are in contact with an inner wall of the side of the housing where the first orifice is located and an inner wall on the opposite side and are fixed to the inner walls by welding.

8. The heat exchange device according to claim 1, wherein the housing is provided with fins, a part of the fins are located between two adjacent flat pipes, and a part of the fins are located between the flat pipes and the inner wall of the housing;

the number of the flow collecting passages of the first flow collecting component is the same as the number of the flow collecting passages of the second flow collecting component; the number of the flow collecting passages is 2 to 10, and an equivalent diameter of a cross section of the flow collecting passages ranges from 5 mm to 25 mm;

each flat pipe has two or more circulation holes, each of the circulation holes is arranged along a width direction of the flat pipe, an equivalent pore diameter of each circulation hole ranges from 0.3 mm to 1.5 mm, and a distance between the centers of two adjacent circulation holes is 0.5 mm to 2.5 mm.

* * * * *